US008850849B2

(12) United States Patent
Martinez et al.

(10) Patent No.: US 8,850,849 B2
(45) Date of Patent: Oct. 7, 2014

3

(54) LIQUEFIED NATURAL GAS AND HYDROCARBON GAS PROCESSING

(71) Applicant: Ortloff Engineers, Ltd., Midland, TX (US)

(72) Inventors: Tony L. Martinez, Odessa, TX (US); John D. Wilkinson, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 0 days.

(21) Appl. No.: 13/686,641

(22) Filed: Nov. 27, 2012

(65) Prior Publication Data

US 2013/0125582 A1 May 23, 2013
US 2014/0096563 A2 Apr. 10, 2014

Related U.S. Application Data

(63) Continuation of application No. 12/423,306, filed on Apr. 14, 2009, now abandoned.

(60) Provisional application No. 61/053,814, filed on May 16, 2008.

(51) Int. Cl.
*F25J 3/00* (2006.01)
*F25J 3/02* (2006.01)

(52) U.S. Cl.
CPC ..... *F25J 3/0209* (2013.01); *F25J 3/0214* (2013.01); *F25J 2210/02* (2013.01)
USPC ..... 62/620; 62/621

(58) Field of Classification Search
CPC ..... F25J 3/0209; F25J 3/0214; F25J 3/0233; F25J 3/0238; F25J 3/06; F25J 3/061; F25J 3/0615; F25J 3/0635; F25J 3/064; F25J 2210/02; F25J 2210/06; F25J 2200/02; F25J 2200/06; F25J 2200/72; F25J 2200/74
USPC ..... 62/617, 618, 620, 630, 632
See application file for complete search history.

(56) References Cited

U.S. PATENT DOCUMENTS 2,603,310 A 7/1952 Gilmore
2,880,592 A 4/1959 Davison et al.

(Continued)

FOREIGN PATENT DOCUMENTS

EP 0 182 643 A2 5/1986
EP 1 114 808 A1 7/2001

(Continued)

OTHER PUBLICATIONS

Mowrey, E. Ross., "Efficient, High Recovery of Liquids from Natural Gas Utilizing a High Pressure Absorber," Proceedings of the Eighty-First Annual Convention of the Gas Processors Association, Dallas, Texas, Mar. 11-13, 2002—10 pages.

(Continued)

*Primary Examiner* — John Pettitt
*Assistant Examiner* — Ignacio E Landeros
(74) *Attorney, Agent, or Firm* — Fitzpatrick, Cella, Harper & Scinto

(57) ABSTRACT

A process for recovering ethane and heavier hydrocarbons from LNG and a hydrocarbon gas stream is disclosed. The LNG feed stream is divided into two portions. The first is supplied to a fractionation column as a first upper mid-column feed. The second portion is heated while condensing a portion of a column distillation stream, thereby producing a "lean" LNG stream and a reflux stream. The reflux stream is supplied as top column feed. The second portion of LNG feed is heated further and supplied to the column as a first lower mid-column feed. The gas stream is divided into two portions. The second is expanded, then both portions are cooled while vaporizing the lean LNG stream and heating another portion of the distillation stream. The colder first portion is supplied to the column as a second upper mid-column feed, and the second is supplied as a second lower mid-column feed.

5 Claims, 8 Drawing Sheets

(56) References Cited

U.S. PATENT DOCUMENTS

| | | | |
|---|---|---|---|
| 2,952,984 | A | 9/1960 | Marshall, Jr. |
| 3,292,380 | A | 12/1966 | Bucklin |
| 3,507,127 | A | 4/1970 | De Marco |
| 3,516,261 | A | 6/1970 | Hoffman |
| 3,524,897 | A | 8/1970 | Kniel |
| 3,656,311 | A | 4/1972 | Kaiser |
| 3,675,435 | A | 7/1972 | Jackson et al. |
| 3,724,226 | A | 4/1973 | Pachaly |
| 3,763,658 | A | 10/1973 | Gaumer, Jr. et al. |
| 3,837,172 | A | 9/1974 | Markbreiter et al. |
| 3,902,329 | A | 9/1975 | King, III et al. |
| 3,983,711 | A | 10/1976 | Solomon |
| 4,002,042 | A | 1/1977 | Pryor et al. |
| 4,004,430 | A | 1/1977 | Solomon et al. |
| 4,033,735 | A | 7/1977 | Swenson |
| 4,061,481 | A | 12/1977 | Campbell et al. |
| 4,065,278 | A | 12/1977 | Newton et al. |
| 4,115,086 | A | 9/1978 | Jordan et al. |
| 4,132,604 | A | 1/1979 | Alexion et al. |
| 4,140,504 | A | 2/1979 | Campbell et al. |
| 4,157,904 | A | 6/1979 | Campbell et al. |
| 4,171,964 | A | 10/1979 | Campbell et al. |
| 4,185,978 | A | 1/1980 | McGalliard et al. |
| 4,203,741 | A | 5/1980 | Bellinger et al. |
| 4,251,249 | A | 2/1981 | Gulsby |
| 4,278,457 | A | 7/1981 | Campbell et al. |
| 4,284,423 | A | 8/1981 | Eakman et al. |
| 4,318,723 | A | 3/1982 | Holmes et al. |
| 4,322,225 | A | 3/1982 | Bellinger et al. |
| 4,356,014 | A | 10/1982 | Higgins |
| 4,368,061 | A | 1/1983 | Mestrallet et al. |
| 4,404,008 | A | 9/1983 | Rentler et al. |
| 4,430,103 | A | 2/1984 | Gray et al. |
| 4,445,916 | A | 5/1984 | Newton |
| 4,445,917 | A | 5/1984 | Chiu |
| 4,453,958 | A | 6/1984 | Gulsby et al. |
| 4,507,133 | A | 3/1985 | Khan et al. |
| 4,519,824 | A | 5/1985 | Huebel |
| 4,525,185 | A | 6/1985 | Newton |
| 4,545,795 | A | 10/1985 | Liu et al. |
| 4,592,766 | A | 6/1986 | Kumman et al. |
| 4,596,588 | A | 6/1986 | Cook |
| 4,600,421 | A | 7/1986 | Kummann |
| 4,617,039 | A | 10/1986 | Buck |
| 4,657,571 | A | 4/1987 | Gazzi |
| 4,676,812 | A | 6/1987 | Kummann |
| 4,687,499 | A | 8/1987 | Aghili |
| 4,689,063 | A | 8/1987 | Paradowski et al. |
| 4,690,702 | A | 9/1987 | Paradowski et al. |
| 4,698,081 | A | 10/1987 | Aghili |
| 4,705,549 | A | 11/1987 | Sapper |
| 4,707,170 | A | 11/1987 | Ayres et al. |
| 4,710,214 | A | 12/1987 | Sharma et al. |
| 4,711,651 | A | 12/1987 | Sharma et al. |
| 4,718,927 | A | 1/1988 | Bauer et al. |
| 4,720,294 | A | 1/1988 | Lucadamo et al. |
| 4,738,699 | A | 4/1988 | Apffel |
| 4,746,342 | A | 5/1988 | DeLong et al. |
| 4,752,312 | A | 6/1988 | Prible |
| 4,755,200 | A | 7/1988 | Liu et al. |
| 4,793,841 | A | 12/1988 | Burr |
| 4,851,020 | A | 7/1989 | Montgomery, IV |
| 4,854,955 | A | 8/1989 | Campbell et al. |
| 4,869,740 | A | 9/1989 | Campbell et al. |
| 4,881,960 | A | 11/1989 | Ranke et al. |
| 4,889,545 | A | 12/1989 | Campbell et al. |
| 4,895,584 | A | 1/1990 | Buck et al. |
| RE33,408 | E | 10/1990 | Khan et al. |
| 4,966,612 | A | 10/1990 | Bauer |
| 4,970,867 | A | 11/1990 | Herron et al. |
| 5,114,451 | A | 5/1992 | Rambo et al. |
| 5,114,541 | A | 5/1992 | Bayer |
| 5,275,005 | A | 1/1994 | Campbell et al. |
| 5,291,736 | A | 3/1994 | Paradowski |
| 5,325,673 | A | 7/1994 | Durr et al. |
| 5,335,504 | A | 8/1994 | Durr et al. |
| 5,363,655 | A | 11/1994 | Kikkawa et al. |
| 5,365,740 | A | 11/1994 | Kikkawa et al. |
| 5,421,165 | A | 6/1995 | Paradowski et al. |
| 5,537,827 | A | 7/1996 | Low et al. |
| 5,555,748 | A | 9/1996 | Campbell et al. |
| 5,566,554 | A | 10/1996 | Vijayaraghavan et al. |
| 5,568,737 | A | 10/1996 | Campbell et al. |
| 5,600,969 | A | 2/1997 | Low |
| 5,615,561 | A | 4/1997 | Houshmand et al. |
| 5,651,269 | A | 7/1997 | Prevost et al. |
| 5,669,234 | A | 9/1997 | Houser et al. |
| 5,675,054 | A | 10/1997 | Manley et al. |
| 5,685,170 | A | 11/1997 | Sorensen |
| 5,737,940 | A | 4/1998 | Yao et al. |
| 5,755,114 | A | 5/1998 | Foglietta |
| 5,755,115 | A | 5/1998 | Manley |
| 5,771,712 | A | 6/1998 | Campbell et al. |
| 5,799,507 | A | 9/1998 | Wilkinson et al. |
| 5,881,569 | A | 3/1999 | Campbell et al. |
| 5,890,377 | A | 4/1999 | Foglietta |
| 5,890,378 | A | 4/1999 | Rambo et al. |
| 5,893,274 | A | 4/1999 | Nagelvoort et al. |
| 5,950,453 | A | 9/1999 | Bowen et al. |
| 5,983,664 | A | 11/1999 | Campbell et al. |
| 5,992,175 | A | 11/1999 | Yao et al. |
| 6,014,869 | A | 1/2000 | Elion et al. |
| 6,016,665 | A | 1/2000 | Cole et al. |
| 6,023,942 | A | 2/2000 | Thomas et al. |
| 6,053,007 | A | 4/2000 | Victory et al. |
| 6,062,041 | A | 5/2000 | Kikkawa et al. |
| 6,116,050 | A | 9/2000 | Yao et al. |
| 6,119,479 | A | 9/2000 | Roberts et al. |
| 6,125,653 | A | 10/2000 | Shu et al. |
| 6,182,469 | B1 | 2/2001 | Campbell et al. |
| 6,237,365 | B1 | 5/2001 | Trebble |
| 6,244,070 | B1 | 6/2001 | Lee et al. |
| 6,250,105 | B1 | 6/2001 | Kimble |
| 6,269,655 | B1 | 8/2001 | Roberts et al. |
| 6,272,882 | B1 | 8/2001 | Hodges et al. |
| 6,308,531 | B1 | 10/2001 | Roberts et al. |
| 6,324,867 | B1 | 12/2001 | Fanning et al. |
| 6,336,344 | B1 | 1/2002 | O'Brien |
| 6,347,532 | B1 | 2/2002 | Agrawal et al. |
| 6,361,582 | B1 | 3/2002 | Pinnau et al. |
| 6,363,744 | B2 | 4/2002 | Finn et al. |
| 6,367,286 | B1 | 4/2002 | Price |
| 6,401,486 | B1 | 6/2002 | Lee et al. |
| 6,453,698 | B2 | 9/2002 | Jain et al. |
| 6,516,631 | B1 | 2/2003 | Trebble |
| 6,526,777 | B1 | 3/2003 | Campbell et al. |
| 6,564,579 | B1 | 5/2003 | McCartney |
| 6,565,626 | B1 | 5/2003 | Baker et al. |
| 6,578,379 | B2 | 6/2003 | Paradowski |
| 6,604,380 | B1 | 8/2003 | Reddick et al. |
| 6,694,775 | B1 | 2/2004 | Higginbotham et al. |
| 6,712,880 | B2 | 3/2004 | Foglietta et al. |
| 6,742,358 | B2 | 6/2004 | Wilkinson et al. |
| 6,889,523 | B2 | 5/2005 | Wilkinson et al. |
| 6,907,752 | B2 | 6/2005 | Schroeder et al. |
| 6,915,662 | B2 | 7/2005 | Wilkinson et al. |
| 6,941,771 | B2 | 9/2005 | Reddick et al. |
| 6,986,266 | B2 | 1/2006 | Narinsky |
| 7,010,937 | B2 | 3/2006 | Wilkinson et al. |
| 7,069,743 | B2 | 7/2006 | Prim |
| 7,155,931 | B2 | 1/2007 | Wilkinson et al. |
| 7,159,417 | B2 | 1/2007 | Foglietta et al. |
| 7,165,423 | B2 | 1/2007 | Winningham |
| 7,191,617 | B2 | 3/2007 | Cuellar et al. |
| 7,204,100 | B2 | 4/2007 | Wilkinson et al. |
| 7,210,311 | B2 | 5/2007 | Wilkinson et al. |
| 7,216,507 | B2 | 5/2007 | Cuellar et al. |
| 7,219,513 | B1 | 5/2007 | Mostafa |
| 7,278,281 | B2 | 10/2007 | Yang et al. |
| 7,565,815 | B2 | 7/2009 | Wilkinson et al. |
| 7,631,516 | B2 | 12/2009 | Cuellar et al. |
| 8,434,325 | B2 | 5/2013 | Martinez et al. |
| 8,590,340 | B2 | 11/2013 | Pitman et al. |
| 2002/0166336 | A1 | 11/2002 | Wilkinson et al. |

(56) References Cited

U.S. PATENT DOCUMENTS

| | | | |
|---|---|---|---|
| 2003/0005722 | A1 | 1/2003 | Wilkinson et al. |
| 2004/0079107 | A1 | 4/2004 | Wilkinson et al. |
| 2004/0172967 | A1 | 9/2004 | Patel et al. |
| 2004/0177646 | A1 | 9/2004 | Wilkinson et al. |
| 2005/0066686 | A1 | 3/2005 | Wilkinson et al. |
| 2005/0204774 | A1 | 9/2005 | Foglietta et al. |
| 2005/0229634 | A1 | 10/2005 | Huebel et al. |
| 2005/0247078 | A1 | 11/2005 | Wilkinson et al. |
| 2005/0268649 | A1 | 12/2005 | Wilkinson et al. |
| 2006/0000234 | A1 | 1/2006 | Cuellar et al. |
| 2006/0032269 | A1 | 2/2006 | Cuellar et al. |
| 2006/0086139 | A1 | 4/2006 | Eaton et al. |
| 2006/0130521 | A1 | 6/2006 | Patel |
| 2006/0260355 | A1 | 11/2006 | Roberts et al. |
| 2006/0260356 | A1 | 11/2006 | Schroeder et al. |
| 2006/0277943 | A1 | 12/2006 | Yokohata et al. |
| 2006/0283207 | A1 | 12/2006 | Pitman et al. |
| 2007/0001322 | A1 | 1/2007 | Aikhorin et al. |
| 2007/0231244 | A1 | 10/2007 | Shah et al. |
| 2008/0000265 | A1 | 1/2008 | Cuellar et al. |
| 2008/0078205 | A1 | 4/2008 | Cuellar et al. |
| 2008/0282731 | A1 | 11/2008 | Cuellar et al. |
| 2009/0100862 | A1 | 4/2009 | Wilkinson et al. |
| 2010/0236285 | A1 | 9/2010 | Johnke et al. |
| 2010/0251764 | A1 | 10/2010 | Johnke et al. |
| 2010/0275647 | A1 | 11/2010 | Johnke et al. |
| 2010/0287983 | A1 | 11/2010 | Johnke et al. |
| 2010/0287984 | A1 | 11/2010 | Johnke et al. |
| 2010/0326134 | A1 | 12/2010 | Johnke et al. |
| 2011/0067441 | A1 | 3/2011 | Martinez et al. |
| 2011/0067442 | A1 | 3/2011 | Martinez et al. |
| 2011/0067443 | A1 | 3/2011 | Martinez et al. |
| 2011/0167868 | A1 | 7/2011 | Pierce et al. |
| 2011/0226011 | A1 | 9/2011 | Johnke et al. |
| 2011/0226012 | A1 | 9/2011 | Johnke et al. |
| 2011/0226013 | A1 | 9/2011 | Johnke et al. |
| 2011/0226014 | A1 | 9/2011 | Johnke et al. |
| 2011/0232328 | A1 | 9/2011 | Johnke et al. |
| 2011/0296867 | A1 | 12/2011 | Cuellar et al. |
| 2013/0283853 | A1 | 10/2013 | Martinez et al. |

FOREIGN PATENT DOCUMENTS

| | | | |
|---|---|---|---|
| FR | 1535846 | A | 8/1968 |
| GB | 2102931 | A | 2/1983 |
| SU | 1606828 | A1 | 10/1986 |
| WO | 99/23428 | A1 | 5/1999 |
| WO | 99/37962 | A1 | 7/1999 |
| WO | 00/33006 | A1 | 6/2000 |
| WO | 00/34724 | A1 | 6/2000 |
| WO | 01/88447 | A1 | 11/2001 |
| WO | 02/14763 | A1 | 2/2002 |
| WO | 2004/076946 | A2 | 9/2004 |
| WO | 2004/109180 | A1 | 12/2004 |
| WO | 2005/015100 | A1 | 2/2005 |
| WO | 2005/035692 | A2 | 4/2005 |
| WO | 2007/001669 | A2 | 1/2007 |

OTHER PUBLICATIONS

B.C. Price et al., "LNG Production for Peak Shaving Operations", Proceedings of the Seventy-eighth Annual Convention of the Gas Processors Association, Nashville, Tennessee, Mar. 1-3, 1999, 8 sheets.

Fig. 16-33, on p. 16-24 of the Engineering Data Book, Twelfth Edition, published by the Gas Processors Suppliers Association 2004.

Finn et al., "LNG Technology for Offshore and Mid-scale Plants", Proceedings of the Seventy-ninth Annual Convention of the Gas Processors Association, Atlanta, Georgia, Mar. 13-15, 2003, 23 sheets.

Kikkawa et al., "Optimize the Power System of Baseload LNG Plant", Proceedings of the Eightieth Annual Convention of the Gas Processors Association, San Antonio, Texas, Mar. 12-14, 2001, 23 sheets.

Huang et al., "Select the Optimum Extraction Method for LNG Regasification; Varying Energy Compositions of LNG Imports may Require Terminal Operators to Remove $C_2$+ Compounds before Injecting Regasified LNG into Pipelines", Hydrocarbon ProcessinJL 83, 57-62, Jul. 2004.

Yang et al., "Cost-Effective Design Reduces C2 and C3 at LNG Receiving Terminals", Oil & Gas Journal, 50-53, May 26, 2003.

LIQUEFIED NATURAL GAS AND HYDROCARBON GAS PROCESSING

This application is a continuation of U.S. Non-Provisional Application No. 12,423,306, filed on Apr. 14, 2009, which claims the benefit of U.S. Provisional Application No. 61/053,814, filed May 16, 2008, both of which are incorporated herein by reference in their entirety.

BACKGROUND OF THE INVENTION

This invention relates to a process for the separation of ethane and heavier hydrocarbons or propane and heavier hydrocarbons from liquefied natural gas (hereinafter referred to as LNG) combined with the separation of a gas containing hydrocarbons to provide a volatile methane-rich gas stream and a less volatile natural gas liquids (NGL) or liquefied petroleum gas (LPG) stream. The applicants claim the benefits under Title 35, United States Code, Section 119(e) of prior U.S. Provisional Application No. 61/053,814 which was filed on May 16, 2008.

As an alternative to transportation in pipelines, natural gas at remote locations is sometimes liquefied and transported in special LNG tankers to appropriate LNG receiving and storage terminals. The LNG can then be re-vaporized and used as a gaseous fuel in the same fashion as natural gas. Although LNG usually has a major proportion of methane, i.e., methane comprises at least 50 mole percent of the LNG, it also contains relatively lesser amounts of heavier hydrocarbons such as ethane, propane, butanes, and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is often also desirable to separate the heavier hydrocarbons from the methane and ethane because these hydrocarbons have a higher value as liquid products (for use as petrochemical feedstocks, as an example) than their value as fuel.

Although there are many processes which may be used to separate ethane and/or propane and heavier hydrocarbons from LNG, these processes often must compromise between high recovery, low utility costs, and process simplicity (and hence low capital investment). U.S. Pat. Nos. 2,952,984; 3,837,172; 5,114,451; and 7,155,931 describe relevant LNG processes capable of ethane or propane recovery while producing the lean LNG as a vapor stream that is thereafter compressed to delivery pressure to enter a gas distribution network. However, lower utility costs may be possible if the lean LNG is instead produced as a liquid stream that can be pumped (rather than compressed) to the delivery pressure of the gas distribution network, with the lean LNG subsequently vaporized using a low level source of external heat or other means. U.S. Pat. Nos. 6,604,380; 6,907,752; 6,941,771; 7,069,743; and 7,216,507 and co-pending application Ser. Nos. 11/749,268 and 12/060,362 describe such processes.

Economics and logistics often dictate that LNG receiving terminals be located close to the natural gas transmission lines that will transport the re-vaporized LNG to consumers. In many cases, these areas also have plants for processing natural gas produced in the region to recover the heavier hydrocarbons contained in the natural gas. Available processes for separating these heavier hydrocarbons include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412; 11/839,693; 11/971,491; and 12/206,230 describe relevant processes (although the description of the present invention is based on different processing conditions than those described in the cited U.S. patents).

The present invention is generally concerned with the integrated recovery of ethylene, ethane, propylene, propane, and heavier hydrocarbons from such LNG and gas streams. It uses a novel process arrangement to integrate the heating of the LNG stream and the cooling of the gas stream to eliminate the need for a separate vaporizer and the need for external refrigeration, allowing high $C_2$ component recovery while keeping the processing equipment simple and the capital investment low. Further, the present invention offers a reduction in the utilities (power and heat) required to process the LNG and gas streams, resulting in lower operating costs than other processes, and also offering significant reduction in capital investment.

Heretofore, assignee's U.S. Pat. No. 7,216,507 has been used to recover $C_2$ components and heavier hydrocarbon components in plants processing LNG, while assignee's U.S. Pat. No. 5,568,737 has been used to recover $C_2$ components and heavier hydrocarbon components in plants processing natural gas. Surprisingly, applicants have found that by integrating certain features of the assignee's U.S. Pat. No. 7,216,507 invention with certain features of the assignee's U.S. Pat. No. 5,568,737, extremely high $C_2$ component recovery levels can be accomplished using less energy than that required by individual plants to process the LNG and natural gas separately.

A typical analysis of an LNG stream to be processed in accordance with this invention would be, in approximate mole percent, 92.2% methane, 6.0% ethane and other $C_2$ components, 1.1% propane and other $C_3$ components, and traces of butanes plus, with the balance made up of nitrogen. A typical analysis of a gas stream to be processed in accordance with this invention would be, in approximate mole percent, 80.1% methane, 9.5% ethane and other $C_2$ components, 5.6% propane and other $C_3$ components, 1.3% isobutane, 1.1% normal butane, 0.8% pentanes plus, with the balance made up of nitrogen and carbon dioxide. Sulfur containing gases are also sometimes present.

For a better understanding of the present invention, reference is made to the following examples and drawings. Referring to the drawings:

FIG. 1 is a flow diagram of a base case natural gas processing plant using LNG to provide its refrigeration;

FIG. 2 is a flow diagram of base case LNG and natural gas processing plants in accordance with U.S. Pat. Nos. 7,216,507 and 5,568,737, respectively;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

Figure 1:
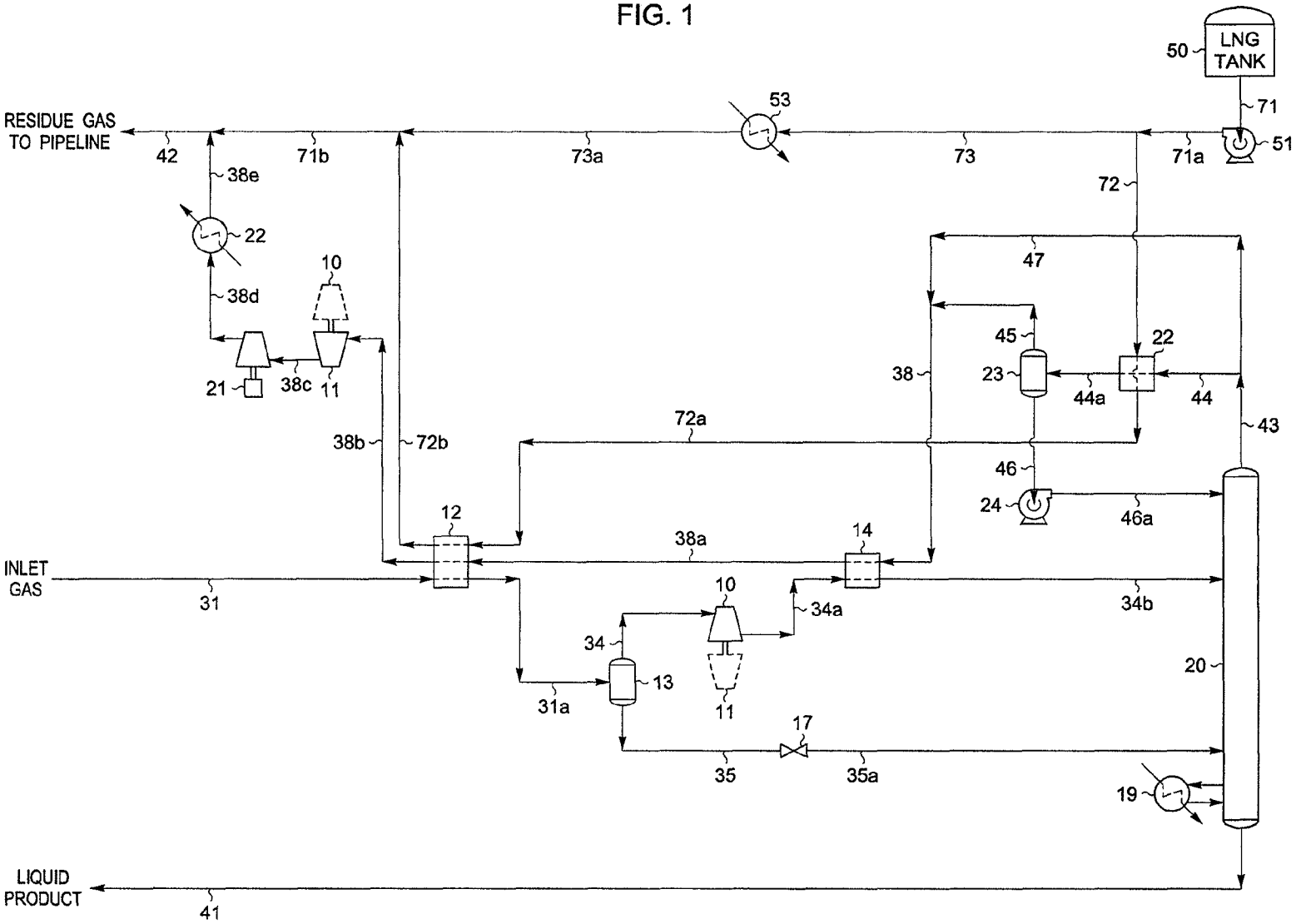
FIGS. 1 and 2 are provided to quantify the advantages of the present invention.

FIG. 1 is a flow diagram showing the design of a processing plant to recover $C_2$+ components from natural gas using an LNG stream to provide refrigeration. In the simulation of the FIG. 1 process, inlet gas enters the plant at 126° F. [52° C.] and 600 psia [4,137 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The inlet gas stream 31 is cooled in heat exchanger 12 by heat exchange with a portion (stream 72*a*) of partially warmed LNG at −174° F. [−114° C.] and cool distillation stream 38*a* at −107° F. [−77° C.]. The cooled stream 31*a* enters separator 13 at 79° F. [−62° C.] and 584 psia [4,027 kPa(a)] where the vapor (stream 34) is separated from the condensed liquid (stream 35). Liquid stream 35 is flash expanded through an appropriate expansion device, such as expansion valve 17, to the operating pressure (approximately 430 psia [2,965 kPa(a)]) of fractionation tower 20. The expanded stream 35*a* leaving expansion valve 17 reaches a temperature of −93° F. [−70° C.] and is supplied to fractionation tower 20 at a first mid-column feed point.

The vapor from separator 13 (stream 34) enters a work expansion machine 10 in which mechanical energy is extracted from this portion of the high pressure feed. The machine 10 expands the vapor substantially isentropically to slightly above the tower operating pressure, with the work expansion cooling the expanded stream 34*a* to a temperature of approximately −101° F. [−74° C.]. The typical commercially available expanders are capable of recovering on the order of 80-88% of the work theoretically available in an ideal isentropic expansion. The work recovered is often used to drive a centrifugal compressor (such as item 11) that can be used to re-compress the heated distillation stream (stream 38*b*), for example. The expanded stream 34*a* is further cooled to −124° F. [−87° C.] in heat exchanger 14 by heat exchange with cold distillation stream 38 at −143° F. [−97° C.], whereupon the partially condensed expanded stream 34*b* is thereafter supplied to fractionation tower 20 at a second mid-column feed point.

The demethanizer in tower 20 is a conventional distillation column containing a plurality of vertically spaced trays, one or more packed beds, or some combination of trays and packing to provide the necessary contact between the liquids falling downward and the vapors rising upward. The column also includes reboilers (such as reboiler 19) which heat and vaporize a portion of the liquids flowing down the column to provide the stripping vapors which flow up the column to strip the liquid product, stream 41, of methane and lighter components. Liquid product stream 41 exits the bottom of the tower at 99° F. [37° C.], based on a typical specification of a methane to ethane ratio of 0.020:1 on a molar basis in the bottom product.

Overhead distillation stream 43 is withdrawn from the upper section of fractionation tower 20 at −143° F. [−97° C.] and is divided into two portions, streams 44 and 47. The first portion, stream 44, flows to reflux condenser 22 where it is cooled to −237° F. [−149° C.] and totally condensed by heat exchange with a portion (stream 72) of the cold LNG (stream 71*a*). Condensed stream 44*a* enters reflux separator 23 wherein the condensed liquid (stream 46) is separated from any uncondensed vapor (stream 45). The liquid stream 46 from reflux separator 23 is pumped by reflux pump 24 to a pressure slightly above the operating pressure of demethanizer 20 and stream 46*a* is then supplied as cold top column feed (reflux) to demethanizer 20. This cold liquid reflux absorbs and condenses the $C_2$ components and heavier hydrocarbon components from the vapors rising in the upper section of demethanizer 20.

The second portion (stream 47) of overhead vapor stream 43 combines with any uncondensed vapor (stream 45) from reflux separator 23 to form cold distillation stream 38 at −143° F. [−97° C.]. Distillation stream 38 passes countercurrently to expanded stream 34*a* in heat exchanger 14 where it is heated to −107° F. [−77° C.] (stream 38*a*), and countercurrently to inlet gas in heat exchanger 12 where it is heated to 47° F. [8° C.] (stream 38*b*). The distillation stream is then re-compressed in two stages. The first stage is compressor 11 driven by expansion machine 10. The second stage is compressor 21 driven by a supplemental power source which compresses stream 38*c* to sales line pressure (stream 38*d*). After cooling to 126° F. [52° C.] in discharge cooler 22, stream 38*e* combines with warm LNG stream 71*b* to form the residue gas product (stream 42). Residue gas stream 42 flows to the sales gas pipeline at 1262 psia [8,701 kPa(a)], sufficient to meet line requirements.

The LNG (stream 71) from LNG tank 50 enters pump 51 at −251° F. [−157° C.]. Pump 51 elevates the pressure of the LNG sufficiently so that it can flow through heat exchangers and thence to the sales gas pipeline. Stream 71*a* exits the pump 51 at −242° F. [−152° C.] and 1364 psia [9,401 kPa(a)] and is divided into two portions, streams 72 and 73. The first portion, stream 72, is heated as described previously to −174° F. [−114° C.] in reflux condenser 22 as it provides cooling to the portion (stream 44) of overhead vapor stream 43 from fractionation tower 20, and to 43° F. [6° C.] in heat exchanger 12 as it provides cooling to the inlet gas. The second portion, stream 73, is heated to 35° F. [2° C.] in heat exchanger 53 using low level utility heat. The heated streams 72*b* and 73*a* recombine to form warm LNG stream 71*b* at 40° F. [4° C.], which thereafter combines with distillation stream 38*e* to form residue gas stream 42 as described previously.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 33,481 | 1,606 | 279 | 39 | 36,221 |
| 35 | 9,064 | 3,442 | 2,693 | 1,619 | 16,924 |
| 43 | 50,499 | 25 | 0 | 0 | 51,534 |
| 44 | 8,055 | 4 | 0 | 0 | 8,221 |
| 45 | 0 | 0 | 0 | 0 | 0 |
| 46 | 8,055 | 4 | 0 | 0 | 8,221 |
| 47 | 42,444 | 21 | 0 | 0 | 43,313 |
| 38 | 42,444 | 21 | 0 | 0 | 43,313 |
| 71 | 40,293 | 2,642 | 491 | 3 | 43,689 |
| 72 | 27,601 | 1,810 | 336 | 2 | 29,927 |
| 73 | 12,692 | 832 | 155 | 1 | 13,762 |
| 42 | 82,737 | 2,663 | 491 | 3 | 87,002 |
| 41 | 101 | 5,027 | 2,972 | 1,658 | 9,832 |

| Recoveries* | | |
|---|---|---|
| Ethane | 65.37% | |
| Propane | 85.83% | |
| Butanes+ | 99.83% | |
| Power | | |
| LNG Feed Pump | 3,561 HP | [5,854 kW] |
| Reflux Pump | 23 HP | [38 kW] |
| Residue Gas Compressor | 24,612 HP | [40,462 kW] |
| Totals | 28,196 HP | [46,354 kW] |
| Low Level Utility Heat | | |
| LNG Heater | 68,990 MBTU/Hr | [44,564 kW] |
| High Level Utility Heat | | |
| Demethanizer Reboiler | 80,020 MBTU/Hr | [51,689 kW] |
| Specific Power | | |
| HP-Hr/Lb. Mole [kW-Hr/kg mole] | 2.868 | [4.715] |

*(Based on un-rounded flow rates)

The recoveries reported in Table I are computed relative to the total quantities of ethane, propane, and butanes+ contained in the gas stream being processed in the plant and in the LNG stream. Although the recoveries are quite high relative to the heavier hydrocarbons contained in the gas being processed (99.58%, 100.00%, and 100.00%, respectively, for ethane, propane, and butanes+), none of the heavier hydrocarbons contained in the LNG stream are captured in the FIG. 1 process. In fact, depending on the composition of LNG stream 71, the residue gas stream 42 produced by the FIG. 1 process may not meet all pipeline specifications. The specific power reported in Table I is the power consumed per unit of liquid product recovered, and is an indicator of the overall process efficiency.

Figure 2:
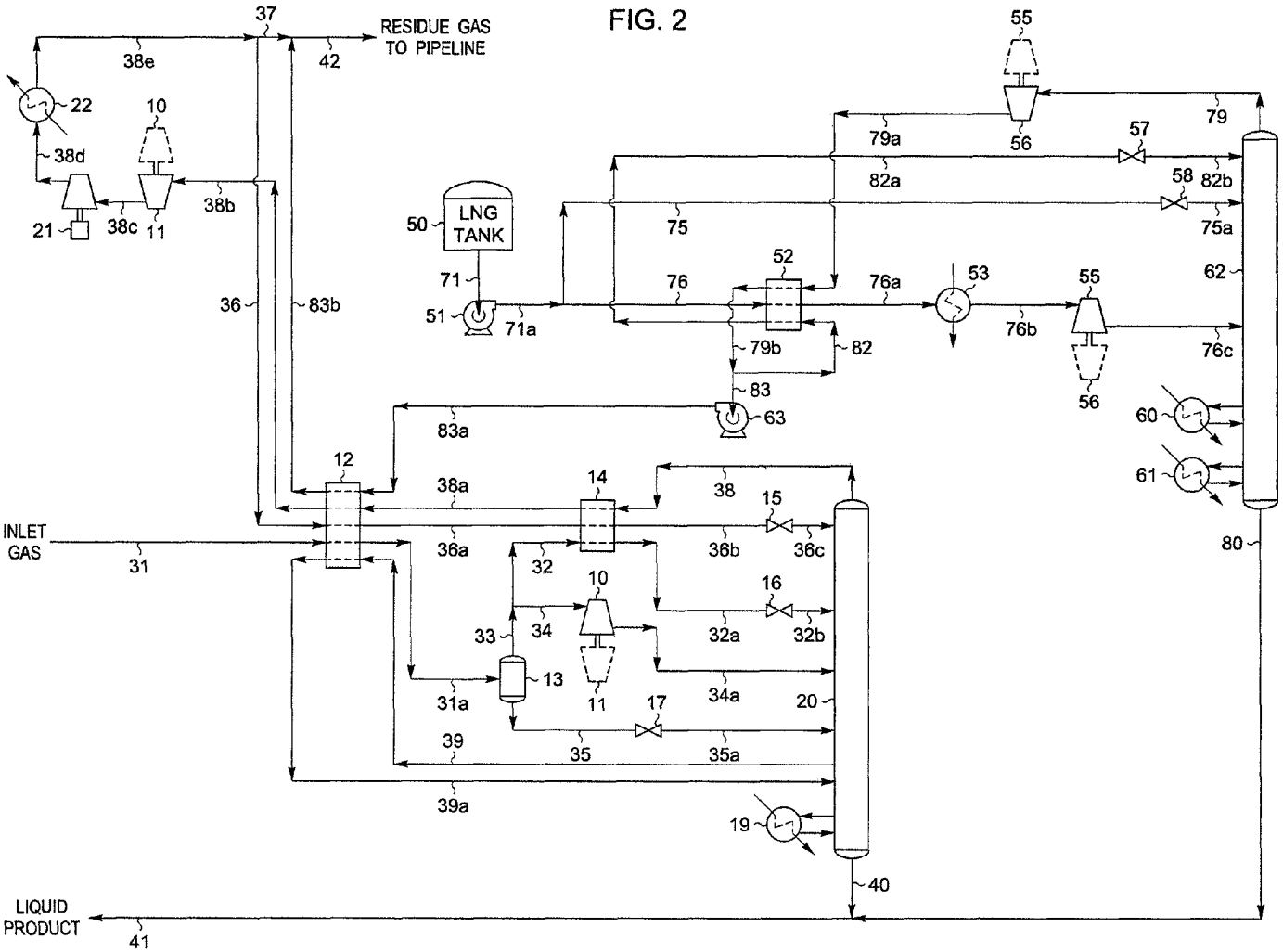

FIG. 2 is a flow diagram showing processes to recover $C_2$+ components from LNG and natural gas in accordance with U.S. Pat. Nos. 7,216,507 and 5,568,737, respectively, with the processed LNG stream used to provide refrigeration for the natural gas plant. The processes of FIG. 2 have been applied to the same LNG stream and inlet gas stream compositions and conditions as described previously for FIG. 1.

In the simulation of the FIG. 2 process, the LNG to be processed (stream 71) from LNG tank 50 enters pump 51 at −251° F. [−157° C.]. Pump 51 elevates the pressure of the LNG sufficiently so that it can flow through heat exchangers and thence to expansion machine 55. Stream 71*a* exits the pump at −242° F. [−152° C.] and 1364 psia [9,401 kPa(a)] and is split into two portions, streams 75 and 76. The first portion, stream 75, is expanded to the operating pressure (approximately 415 psia [2,859 kPa(a)]) of fractionation column 62 by expansion valve 58. The expanded stream 75*a* leaves expansion valve 58 at −238° F. [−150° C.] and is thereafter supplied to tower 62 at an upper mid-column feed point.

The second portion, stream 76, is heated to −79° F. [−62° C.] in heat exchanger 52 by cooling compressed overhead distillation stream 79*a* at −70° F. [−57° C.] and reflux stream 82 at −128° F. [−89° C.]. The partially heated stream 76*a* is further heated and vaporized in heat exchanger 53 using low level utility heat. The heated stream 76*b* at −5° F. [−20° C.] and 1334 psia [9,195 kPa(a)] enters work expansion machine 55 in which mechanical energy is extracted from this portion of the high pressure feed. The machine 55 expands the vapor substantially isentropically to the tower operating pressure, with the work expansion cooling the expanded stream 76*c* to a temperature of approximately −107° F. [−77° C.] before it is supplied as feed to fractionation column 62 at a lower mid-column feed point.

The demethanizer in fractionation column 62 is a conventional distillation column containing a plurality of vertically spaced trays, one or more packed beds, or some combination of trays and packing consisting of two sections. The upper absorbing (rectification) section contains the trays and/or packing to provide the necessary contact between the vapors rising upward and cold liquid falling downward to condense and absorb the ethane and heavier components; the lower stripping (demethanizing) section contains the trays and/or packing to provide the necessary contact between the liquids falling downward and the vapors rising upward. The demethanizing section also includes one or more reboilers (such as side reboiler 60 using low level utility heat, and reboiler 61 using high level utility heat) which heat and vaporize a portion of the liquids flowing down the column to provide the stripping vapors which flow up the column. The column liquid stream 80 exits the bottom of the tower at 54° F. [12° C.], based on a typical specification of a methane to ethane ratio of 0.020:1 on a molar basis in the bottom product.

Overhead distillation stream 79 is withdrawn from the upper section of fractionation tower 62 at −144° F. [−98° C.] and flows to compressor 56 driven by expansion machine 55, where it is compressed to 807 psia [5,567 kPa(a)] (stream 79*a*). At this pressure, the stream is totally condensed as it is cooled to −128° F. [−89° C.] in heat exchanger 52 as described previously. The condensed liquid (stream 79*b*) is then divided into two portions, streams 83 and 82. The first portion (stream 83) is the methane-rich lean LNG stream, which is pumped by pump 63 to 1270 psia [8,756 kPa(a)] for subsequent vaporization in heat exchanger 12, heating stream 83*a* to 40° F. [4° C.] as described below to produce warm lean LNG stream 83*b*.

The remaining portion of condensed liquid stream 79*b*, reflux stream 82, flows to heat exchanger 52 where it is subcooled to −237° F. [−149° C.] by heat exchange with a portion of the cold LNG (stream 76) as described previously. The subcooled stream 82*a* is then expanded to the operating pressure of demethanizer 62 by expansion valve 57. The expanded stream 82*b* at −236° F. [−149° C.] is then supplied as cold top column feed (reflux) to demethanizer 62. This cold liquid reflux absorbs and condenses the $C_2$ components and heavier hydrocarbon components from the vapors rising in the upper rectification section of demethanizer 62.

In the simulation of the FIG. 2 process, inlet gas enters the plant at 126° F. [52° C.] and 600 psia [4,137 kPa(a)] as stream 31. The feed stream 31 is cooled in heat exchanger 12 by heat exchange with cold lean LNG (stream 83*a*) at −116° F. [−82° C.], cool distillation stream 38*a* at −96° F. [−71° C.], and demethanizer liquids (stream 39) at −3° F. [−20° C.]. The cooled stream 31*a* enters separator 13 at −67° F. [−55° C.] and 584 psia [4,027 kPa(a)] where the vapor (stream 33) is separated from the condensed liquid (stream 35). Liquid stream 35 is flash expanded through an appropriate expansion device, such as expansion valve 17, to the operating pressure (approximately 375 psia [2,583 kPa(a)]) of fractionation tower 20. The expanded stream 35*a* leaving expansion valve 17 reaches a temperature of −86° F. [−65° C.] and is supplied to fractionation tower 20 at a first lower mid-column feed point.

Vapor stream 33 from separator 13 is divided into two streams, 32 and 34. Stream 32, containing about 22% of the total vapor, passes through heat exchanger 14 in heat exchange relation with cold distillation stream 38 at −150° F. [−101° C.] where it is cooled to substantial condensation. The resulting substantially condensed stream 32*a* at −144° F. [−98° C.] is then flash expanded through an appropriate expansion device, such as expansion valve 16, to the operating pressure of fractionation tower 20, cooling stream 32*b* to −148° F. [−100° C.] before it is supplied to fractionation tower 20 at an upper mid-column feed point.

The remaining 78% of the vapor from separator 13 (stream 34) enters a work expansion machine 10 in which mechanical energy is extracted from this portion of the high pressure feed. The machine 10 expands the vapor substantially isentropically to the tower operating pressure, with the work expansion cooling the expanded stream 34*a* to a temperature of approximately −100° F. [−73° C.]. The partially condensed expanded stream 34*a* is thereafter supplied as feed to fractionation tower 20 at a second lower mid-column feed point.

The demethanizer in fractionation column 20 is a conventional distillation column containing a plurality of vertically spaced trays, one or more packed beds, or some combination of trays and packing consisting of two sections. The upper absorbing (rectification) section contains the trays and/or packing to provide the necessary contact between the vapors rising upward and cold liquid falling downward to condense and absorb the ethane and heavier components; the lower stripping (demethanizing) section contains the trays and/or packing to provide the necessary contact between the liquids falling downward and the vapors rising upward. The demethanizing section also includes one or more reboilers (such as the side reboiler in heat exchanger 12 described previously, and reboiler 19 using high level utility heat) which heat and vaporize a portion of the liquids flowing down the column to provide the stripping vapors which flow up the column. The column liquid stream 40 exits the bottom of the tower at 85° F. [30° C.], based on a typical specification of a methane to ethane ratio of 0.020:1 on a molar basis in the bottom product, and combines with stream 80 to form the liquid product (stream 41).

Overhead distillation stream 38 is withdrawn from the upper section of fractionation tower 20 at −150° F. [−101° C.]. It passes countercurrently to vapor stream 32 and recycle stream 36*a* in heat exchanger 14 where it is heated to −96° F. [−71° C.] (stream 38*a*), and countercurrently to inlet gas stream 31 and recycle stream 36 in heat exchanger 12 where it is heated to 6° F. [−15° C.] (stream 38*b*). The distillation stream is then re-compressed in two stages. The first stage is compressor 11 driven by expansion machine 10. The second stage is compressor 21 driven by a supplemental power source which compresses stream 38*c* to sales line pressure (stream 38*d*). After cooling to 126° F. [52° C.] in discharge cooler 22, stream 38*e* is divided into two portions, stream 37 and recycle stream 36. Stream 37 combines with warm lean LNG stream 83*b* to form the residue gas product (stream 42). Residue gas stream 42 flows to the sales gas pipeline at 1262 psia [8,701 kPa(a)], sufficient to meet line requirements.

Recycle stream 36 flows to heat exchanger 12 and is cooled to −102° F. [−75° C.] by heat exchange with cool lean LNG (stream 83*a*), cool distillation stream 38*a*, and demethanizer liquids (stream 39) as described previously. Stream 36*a* is further cooled to −144° F. [−98° C.] by heat exchange with cold distillation stream 38 in heat exchanger 14 as described previously. The substantially condensed stream 36*b* is then expanded through an appropriate expansion device, such as expansion valve 15, to the demethanizer operating pressure, resulting in cooling of the total stream to −152° F. [−102° C.]. The expanded stream 36*c* is then supplied to fractionation tower 20 as the top column feed. The vapor portion of stream 36*c* combines with the vapors rising from the top fractionation stage of the column to form distillation stream 38, which is withdrawn from an upper region of the tower as described above.

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 33 | 36,197 | 2,152 | 429 | 64 | 39,690 |
| 35 | 6,348 | 2,896 | 2,543 | 1,594 | 13,455 |
| 32 | 8,027 | 477 | 95 | 14 | 8,801 |
| 34 | 28,170 | 1,675 | 334 | 50 | 30,889 |
| 38 | 52,982 | 30 | 0 | 0 | 54,112 |
| 36 | 10,537 | 6 | 0 | 0 | 10,762 |
| 37 | 42,445 | 24 | 0 | 0 | 43,350 |
| 40 | 100 | 5,024 | 2,972 | 1,658 | 9,795 |
| 71 | 40,293 | 2,642 | 491 | 3 | 43,689 |
| 75 | 4,835 | 317 | 59 | 0 | 5,243 |
| 76 | 35,458 | 2,325 | 432 | 3 | 38,446 |
| 79 | 45,588 | 16 | 0 | 0 | 45,898 |
| 82 | 5,348 | 2 | 0 | 0 | 5,385 |
| 83 | 40,240 | 14 | 0 | 0 | 40,513 |
| 80 | 53 | 2,628 | 491 | 3 | 3,176 |
| 42 | 82,685 | 38 | 0 | 0 | 83,863 |
| 41 | 153 | 7,652 | 3,463 | 1,661 | 12,971 |

| Recoveries* | | |
|---|---|---|
| Ethane | 99.51% | |
| Propane | 100.00% | |
| Butanes+ | 100.00% | |
| Power | | |
| LNG Feed Pump | 3,561 HP | [5,854 kW] |
| LNG Product Pump | 1,746 HP | [2,870 kW] |
| Residue Gas Compressor | 31,674 HP | [52,072 kW] |
| Totals | 36,981 HP | [60,796 kW] |
| Low Level Utility Heat | | |
| Liquid Feed Heater | 66,200 MBTU/Hr | [42,762 kW] |
| Demethanizer Reboiler 60 | 23,350 MBTU/Hr | [15,083 kW] |
| Totals | 89,550 MBTU/Hr | [57,845 kW] |
| High Level Utility Heat | | |
| Demethanizer Reboiler 19 | 20,080 MBTU/Hr | [12,971 kW] |
| Demethanizer Reboiler 61 | 3,400 MBTU/Hr | [2,196 kW] |
| Totals | 23,480 MBTU/Hr | [15,167 kW] |

TABLE II-continued

| (FIG. 2) Stream Flow Summary - Lb. Moles/Hr [kg moles/Hr] | | |
|---|---|---|
| Specific Power | | |
| HP-Hr/Lb. Mole [kW-Hr/kg mole] | 2.851 | [4.687] |

*(Based on un-rounded flow rates)

Comparison of the recovery levels displayed in Tables I and II shows that the liquids recovery of the FIG. 2 processes is much higher than that of the FIG. 1 process due to the recovery of the heavier hydrocarbon liquids contained in the LNG stream in fractionation tower 62. The ethane recovery improves from 65.37% to 99.51%, the propane recovery improves from 85.83% to 100.00%, and the butanes+ recovery improves from 99.83% to 100.00%. In addition, the process efficiency of the FIG. 2 processes is improved by about 1% in terms of the specific power relative to the FIG. 1 process.

DESCRIPTION OF THE INVENTION

Example 1

Figure 3:
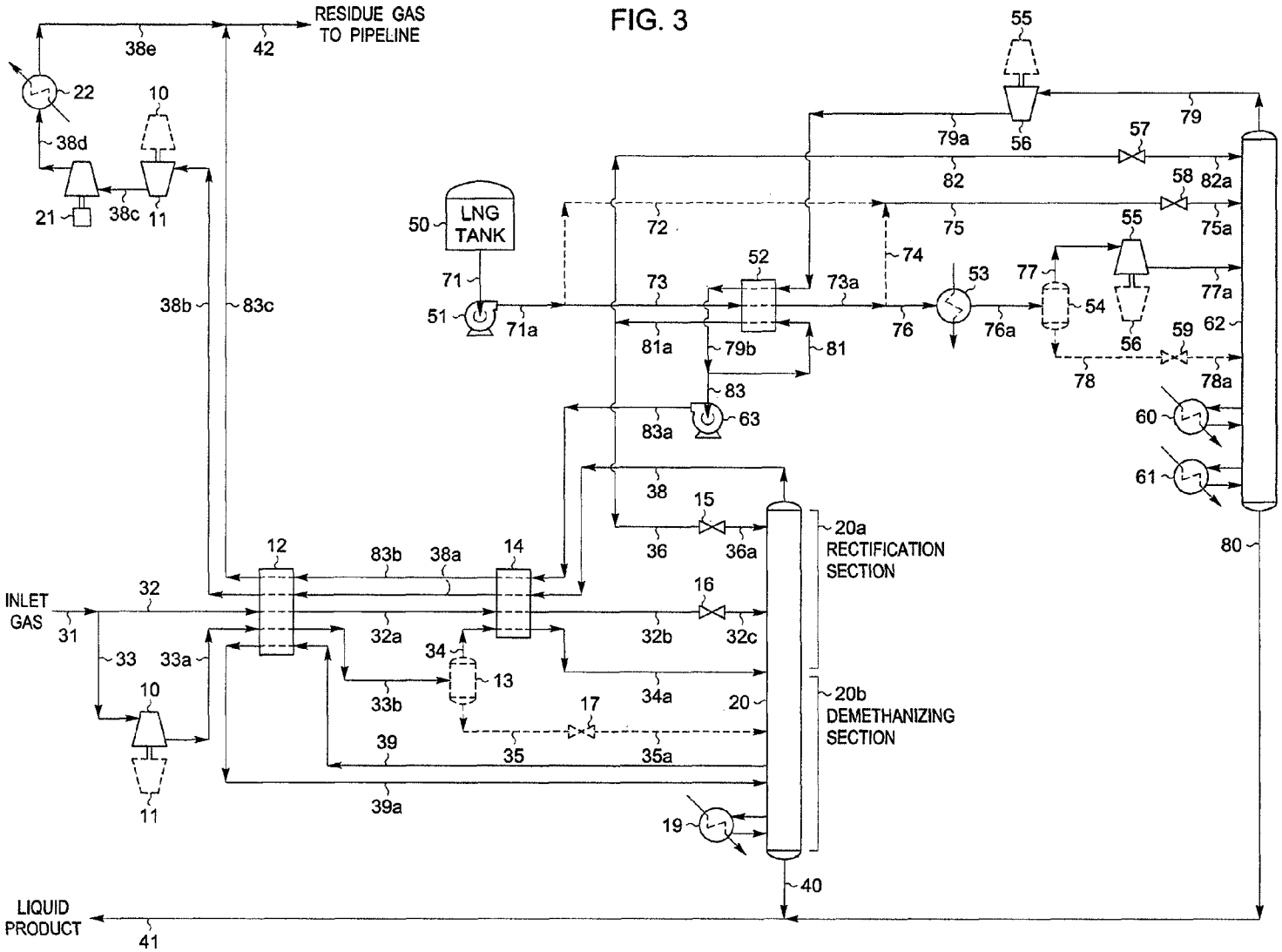
FIG. 3 is a flow diagram of an LNG and natural gas processing plant in accordance with the present invention.

FIG. 3 illustrates a flow diagram of a process in accordance with the present invention. The LNG stream and inlet gas stream compositions and conditions considered in the process presented in FIG. 3 are the same as those in the FIG. 1 and FIG. 2 processes. Accordingly, the FIG. 3 process can be compared with the FIG. 1 and FIG. 2 processes to illustrate the advantages of the present invention.

In the simulation of the FIG. 3 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,401 kPa(a)] and is split into two portions, streams 72 and 73. The first portion, stream 72, becomes stream 75 and is expanded to the operating pressure (approximately 415 psia [2,859 kPa(a)]) of fractionation column 62 by expansion valve 58. The expanded stream 75*a* leaves expansion valve 58 at −238° F. [−150° C.] and is thereafter supplied to tower 62 at an upper mid-column feed point.

The second portion, stream 73, is heated prior to entering separator 54 so that all or a portion of it is vaporized. In the example shown in FIG. 3, stream 73 is first heated to −77° F. [−61° C.] in heat exchanger 52 by cooling compressed overhead distillation stream 79*a* at −70° F. [−57° C.] and reflux stream 81 at −116° F. [−82° C.]. The partially heated stream 73*a* becomes stream 76 and is further heated in heat exchanger 53 using low level utility heat. (High level utility heat, such as the heating medium used in tower reboiler 61, is normally more expensive than low level utility heat, so lower operating cost is usually achieved when use of low level heat, such as sea water, is maximized and the use of high level utility heat is minimized.) Note that in all cases exchangers 52 and 53 are representative of either a multitude of individual heat exchangers or a single multi-pass heat exchanger, or any combination thereof. (The decision as to whether to use more than one heat exchanger for the indicated heating services will depend on a number of factors including, but not limited to, inlet LNG flow rate, heat exchanger size, stream temperatures, etc.)

The heated stream 76*a* enters separator 54 at −5° F. [−20° C.] and 1334 psia [9,195 kPa(a)] where the vapor (stream 77) is separated from any remaining liquid (stream 78). Vapor stream 77 enters a work expansion machine 55 in which mechanical energy is extracted from this portion of the high pressure feed. The machine 55 expands the vapor substantially isentropically to the tower operating pressure, with the work expansion cooling the expanded stream 77*a* to a temperature of approximately −107° F. [−77° C.]. The work recovered is often used to drive a centrifugal compressor (such as item 56) that can be used to re-compress the column overhead vapor (stream 79), for example. The partially condensed expanded stream 77*a* is thereafter supplied as feed to fractionation column 62 at a lower mid-column feed point. The separator liquid (stream 78), if any, is expanded to the operating pressure of fractionation column 62 by expansion valve 59 before expanded stream 78*a* is supplied to fractionation tower 62 at a second lower mid-column feed point.

The demethanizer in fractionation column 62 is a conventional distillation column containing a plurality of vertically spaced trays, one or more packed beds, or some combination of trays and packing. The fractionation tower 62 may consist of two sections. The upper absorbing (rectification) section contains the trays and/or packing to provide the necessary contact between the vapors rising upward and cold liquid falling downward to condense and absorb the ethane and heavier components; the lower stripping (demethanizing) section contains the trays and/or packing to provide the necessary contact between the liquids falling downward and the vapors rising upward. The demethanizing section also includes one or more reboilers (such as side reboiler 60 using low level utility heat, and reboiler 61 using high level utility heat) which heat and vaporize a portion of the liquids flowing down the column to provide the stripping vapors which flow up the column. The column liquid stream 80 exits the bottom of the tower at 54° F. [12° C.], based on a typical specification of a methane to ethane ratio of 0.020:1 on a molar basis in the bottom product.

Overhead distillation stream 79 is withdrawn from the upper section of fractionation tower 62 at −144° F. [−98° C.] and flows to compressor 56 driven by expansion machine 55, where it is compressed to 805 psia [5,554 kPa(a)] (stream 79*a*). At this pressure, the stream is totally condensed as it is cooled to −116° F. [−82° C.] in heat exchanger 52 as described previously. The condensed liquid (stream 79*b*) is then divided into two portions, streams 83 and 81. The first portion (stream 83) is the methane-rich lean LNG stream, which is pumped by pump 63 to 1275 psia [8,791 kPa(a)] for subsequent vaporization in heat exchangers 14 and 12, heating stream 83*a* to −94° F. [−70° C.] and 40° F. [4° C.], respectively, as described below to produce warm lean LNG stream 83*c*.

The remaining portion of condensed liquid stream 79*b*, stream 81, flows to heat exchanger 52 where it is subcooled to −237° F. [−149° C.] by heat exchange with a portion of the cold LNG (stream 73) as described previously. The subcooled stream 81*a* is then divided into two portions, streams 82 and 36. The first portion, reflux stream 82, is expanded to the operating pressure of demethanizer 62 by expansion valve 57. The expanded stream 82*a* at −236° F. [−149° C.] is then supplied as cold top column feed (reflux) to demethanizer 62. This cold liquid reflux absorbs and condenses the $C_2$ components and heavier hydrocarbon components from the vapors rising in the upper rectification section of demethanizer 62. The disposition of the second portion, reflux stream 36 for demethanizer 20, is described below.

In the simulation of the FIG. 3 process, inlet gas enters the plant at 126° F. [52° C.] and 600 psia [4,137 kPa(a)] as stream 31. The feed stream 31 is divided into two portions, streams 32 and 33. The first portion, stream 32, is cooled in heat exchanger 12 by heat exchange with cool lean LNG (stream 83*b*) at −94° F. [−70° C.], cool distillation stream 38*a* at −94° F. [−70° C.], and demethanizer liquids (stream 39) at −78° F. [−61° C.]. The partially cooled stream 32*a* is further cooled from −89° F. [−67° C.] to −120° F. [−85° C.] in heat exchanger 14 by heat exchange with cold lean LNG (stream 83*a*) at −97° F. [−72° C.] and cold distillation stream 38 at −144° F. [−98° C.]. Note that in all cases exchangers 12 and 14 are representative of either a multitude of individual heat exchangers or a single multi-pass heat exchanger, or any combination thereof. (The decision as to whether to use more than one heat exchanger for the indicated heating services will depend on a number of factors including, but not limited to, inlet gas flow rate, heat exchanger size, stream temperatures, etc.) The substantially condensed stream 32*b* is then flash expanded through an appropriate expansion device, such as expansion valve 16, to the operating pressure (approximately 415 psia [2,861 kPa(a)]) of fractionation tower 20, cooling stream 32*c* to −132° F. [−91° C.] before it is supplied to fractionation tower 20 at an upper mid-column feed point.

The second portion of feed stream 31, stream 33, enters a work expansion machine 10 in which mechanical energy is extracted from this portion of the high pressure feed. The machine 10 expands the vapor substantially isentropically to a pressure slightly above the operating pressure of fractionation tower 20, with the work expansion cooling the expanded stream 33*a* to a temperature of approximately 92° F. [33° C.]. The work recovered is often used to drive a centrifugal compressor (such as item 11) that can be used to re-compress the heated distillation stream (stream 38*b*), for example. The expanded stream 33*a* is further cooled in heat exchanger 12 by heat exchange with cool lean LNG (stream 83*b*), cool distillation stream 38*a*, and demethanizer liquids (stream 39) as described previously. The further cooled stream 33*b* enters separator 13 at −84° F. [−65° C.] and 423 psia [2,916 kPa(a)] where the vapor (stream 34) is separated from the condensed liquid (stream 35).

Vapor stream 34 is cooled to −120° F. [−85° C.] in heat exchanger 14 by heat exchange with cold lean LNG (stream 83*a*) and cold distillation stream 38 as described previously. The partially condensed stream 34*a* is then supplied to fractionation tower 20 at a first lower mid-column feed point. Liquid stream 35 is flash expanded through an appropriate expansion device, such as expansion valve 17, to the operating pressure of fractionation tower 20. The expanded stream 35*a* leaving expansion valve 17 reaches a temperature of −85° F. [−65° C.] and is supplied to fractionation tower 20 at a second lower mid-column feed point.

The second portion of subcooled stream 81*a*, reflux stream 36, is expanded to the operating pressure of demethanizer 20 by expansion valve 15. The expanded stream 36*a* at −236° F. [−149° C.] is then supplied as cold top column feed (reflux) to demethanizer 20. This cold liquid reflux absorbs and condenses the $C_2$ components and heavier hydrocarbon components from the vapors rising in upper rectification section 20*a* of demethanizer 20.

The demethanizer in fractionation column 20 is a conventional distillation column containing a plurality of vertically spaced trays, one or more packed beds, or some combination of trays and packing. The fractionation tower 20 may consist of two sections. The upper absorbing (rectification) section 20*a* contains the trays and/or packing to provide the necessary contact between the vapors rising upward and cold liquid falling downward to condense and absorb the ethane and heavier components; the lower stripping (demethanizing) section 20*b* contains the trays and/or packing to provide the necessary contact between the liquids falling downward and the vapors rising upward. Demethanizing section 20*b* also includes one or more reboilers (such as the side reboiler in heat exchanger 12 described previously, and reboiler 19 using high level utility heat) which heat and vaporize a portion of the liquids flowing down the column to provide the stripping vapors which flow up the column. The column liquid stream 40 exits the bottom of the tower at 95° F. [35° C.], based on a typical specification of a methane to ethane ratio of 0.020:1 on a molar basis in the bottom product, and combines with stream 80 to form the liquid product (stream 41).

Overhead distillation stream 38 is withdrawn from the upper section of fractionation tower 20 at −144° F. [−98° C.]. It passes countercurrently to the first portion (stream 32*a*) of inlet gas stream 31 and vapor stream 34 in heat exchanger 14 where it is heated to −94° F. [−70° C.] (stream 38*a*), and countercurrently to the first portion (stream 32) of inlet gas stream 31 and expanded second portion (stream 33*a*) in heat exchanger 12 where it is heated to 13° F. [−11° C.] (stream 38*b*). The distillation stream is then re-compressed in two stages. The first stage is compressor 11 driven by expansion machine 10. The second stage is compressor 21 driven by a supplemental power source which compresses stream 38*c* to sales gas line pressure (stream 38*d*). After cooling to 126° F. [52° C.] in discharge cooler 22, stream 38*e* combines with warm lean LNG stream 83*c* to form the residue gas product (stream 42). Residue gas stream 42 flows to the sales gas pipeline at 1262 psia [8,701 kPa(a)], sufficient to meet line requirements.

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 32 | 5,531 | 656 | 386 | 215 | 6,909 |
| 33 | 37,014 | 4,392 | 2,586 | 1,443 | 46,236 |
| 34 | 32,432 | 1,703 | 255 | 29 | 35,166 |
| 35 | 4,582 | 2,689 | 2,331 | 1,414 | 11,070 |
| 36 | 7,720 | 2 | 0 | 0 | 7,773 |
| 38 | 50,165 | 24 | 0 | 0 | 51,078 |
| 40 | 100 | 5,026 | 2,972 | 1,658 | 9,840 |
| 71 | 40,293 | 2,642 | 491 | 3 | 43,689 |
| 72/75 | 4,916 | 322 | 60 | 0 | 5,330 |
| 73/76 | 35,377 | 2,320 | 431 | 3 | 38,359 |
| 77 | 35,377 | 2,320 | 431 | 3 | 38,359 |
| 78 | 0 | 0 | 0 | 0 | 0 |
| 79 | 45,682 | 14 | 0 | 0 | 45,990 |
| 81 | 13,162 | 4 | 0 | 0 | 13,251 |
| 83 | 32,520 | 10 | 0 | 0 | 32,739 |
| 82 | 5,442 | 2 | 0 | 0 | 5,478 |
| 80 | 53 | 2,630 | 491 | 3 | 3,177 |
| 42 | 82,685 | 34 | 0 | 0 | 83,817 |
| 41 | 153 | 7,656 | 3,463 | 1,661 | 13,017 |

| Recoveries* | | |
|---|---|---|
| Ethane | 99.55% | |
| Propane | 100.00% | |
| Butanes+ | 100.00% | |
| Power | | |
| LNG Feed Pump | 3,561 HP | [5,854 kW] |
| LNG Product Pump | 1,740 HP | [2,861 kW] |
| Residue Gas Compressor | 24,852 HP | [40,856 kW] |
| Totals | 30,153 HP | [49,571 kW] |

TABLE III-continued (FIG. 3)
Stream Flow Summary - Lb. Moles/Hr [kg moles/Hr]

| | | |
|---|---|---|
| Low Level Utility Heat | | |
| Liquid Feed Heater | 65,000 MBTU/Hr | [41,987 kW] |
| Demethanizer Reboiler 60 | 19,000 MBTU/Hr | [12,273 kW] |
| Totals | 84,000 MBTU/Hr | [54,260 kW] |
| High Level Utility Heat | | |
| Demethanizer Reboiler 19 | 41,460 MBTU/Hr | [26,781 kW] |
| Demethanizer Reboiler 61 | 8,400 MBTU/Hr | [5,426 kW] |
| Totals | 49,860 MBTU/Hr | [32,207 kW] |
| Specific Power | | |
| HP-Hr/Lb. Mole [kW-Hr/kg mole] | 2.316 | [3.808] |

*(Based on un-rounded flow rates)

The improvement offered by the FIG. 3 embodiment of the present invention is astonishing compared to the FIG. 1 and FIG. 2 processes. Comparing the recovery levels displayed in Table III above for the FIG. 3 embodiment with those in Table I for the FIG. 1 process shows that the FIG. 3 embodiment of the present invention improves the ethane recovery from 65.37% to 99.55%, the propane recovery from 85.83% to 100.00%, and the butanes+ recovery from 99.83% to 100.00%. Further, comparing the utilities consumptions in Table III with those in Table I shows that although the power required for the FIG. 3 embodiment of the present invention is approximately 7% higher than the FIG. 1 process, the process efficiency of the FIG. 3 embodiment of the present invention is significantly better than that of the FIG. 1 process. The gain in process efficiency is clearly seen in the drop in the specific power, from 2.868 HP-Hr/Lb. Mole [4.715 kW-Hr/kg mole] for the FIG. 1 process to 2.316 HP-Hr/Lb. Mole [3.808 kW-Hr/kg mole] for the FIG. 3 embodiment of the present invention, an increase of more than 19% in the production efficiency.

Comparing the recovery levels displayed in Table III for the FIG. 3 embodiment with those in Table II for the FIG. 2 processes shows that the liquids recovery levels are essentially the same. However, comparing the utilities consumptions in Table III with those in Table II shows that the power required for the FIG. 3 embodiment of the present invention is about 18% lower than the FIG. 2 processes. This results in reducing the specific power from 2.851 HP-Hr/Lb. Mole [4.687 kW-Hr/kg mole] for the FIG. 2 processes to 2.316 HP-Hr/Lb. Mole [3.808 kW-Hr/kg mole] for the FIG. 3 embodiment of the present invention, an improvement of nearly 19% in the production efficiency.

There are six primary factors that account for the improved efficiency of the present invention. First, compared to many prior art processes, the present invention does not depend on the LNG feed itself to directly serve as the reflux for fractionation column 62. Rather, the refrigeration inherent in the cold LNG is used in heat exchanger 52 to generate a liquid reflux stream (stream 82) that contains very little of the $C_2$ components and heavier hydrocarbon components that are to be recovered, resulting in efficient rectification in the absorbing section of fractionation tower 62 and avoiding the equilibrium limitations of such prior art processes. Second, splitting the LNG feed into two portions before feeding fractionation column 62 allows more efficient use of low level utility heat, thereby reducing the amount of high level utility heat consumed by reboiler 61. The cold portion of the LNG feed (stream 75*a*) serves as a supplemental reflux stream for fractionation tower 62, providing partial rectification of the vapors in the expanded vapor and liquid streams (streams 77*a* and 78*a*, respectively) so that heating and at least partially vaporizing the other portion (stream 73) of the LNG feed does not unduly increase the condensing load in heat exchanger 52. Third, using a portion of the cold LNG feed (stream 75*a*) as a supplemental reflux stream allows using less top reflux (stream 82*a*) for fractionation tower 62. The lower top reflux flow, plus the greater degree of heating using low level utility heat in heat exchanger 53, results in less total liquid feeding fractionation column 62, reducing the duty required in reboiler 61 and minimizing the amount of high level utility heat needed to meet the specification for the bottom liquid product from demethanizer 62.

Fourth, using the cold lean LNG stream 83*a* to provide "free" refrigeration to the gas streams in heat exchangers 12 and 14 eliminates the need for a separate vaporization means (such as heat exchanger 53 in the FIG. 1 process) to re-vaporize the LNG prior to delivery to the sales gas pipeline. Fifth, cooling a portion (stream 32) of inlet gas stream 31 to substantial condensation prior to expansion to the operating pressure of demethanizer 20 allows the expanded substantially condensed stream 32*c* to serve as a supplemental reflux stream for fractionation tower 20, providing partial rectification of the vapors in the partially condensed vapor and expanded liquid streams (streams 34*a* and 35*a*, respectively) so that less top reflux (stream 36*a*) is needed for fractionation tower 20. Sixth, integrating the LNG plant with the gas plant allows using a portion (stream 36) of the lean LNG as reflux for demethanizer 20. The resulting stream 36*a* is very cold and contains very little of the $C_2$ components and heavier hydrocarbon components that are to be recovered, resulting in very efficient rectification in absorbing section 20*a* and further minimizing the quantity of reflux required for demethanizer 20.

Example 2

Figure 4:
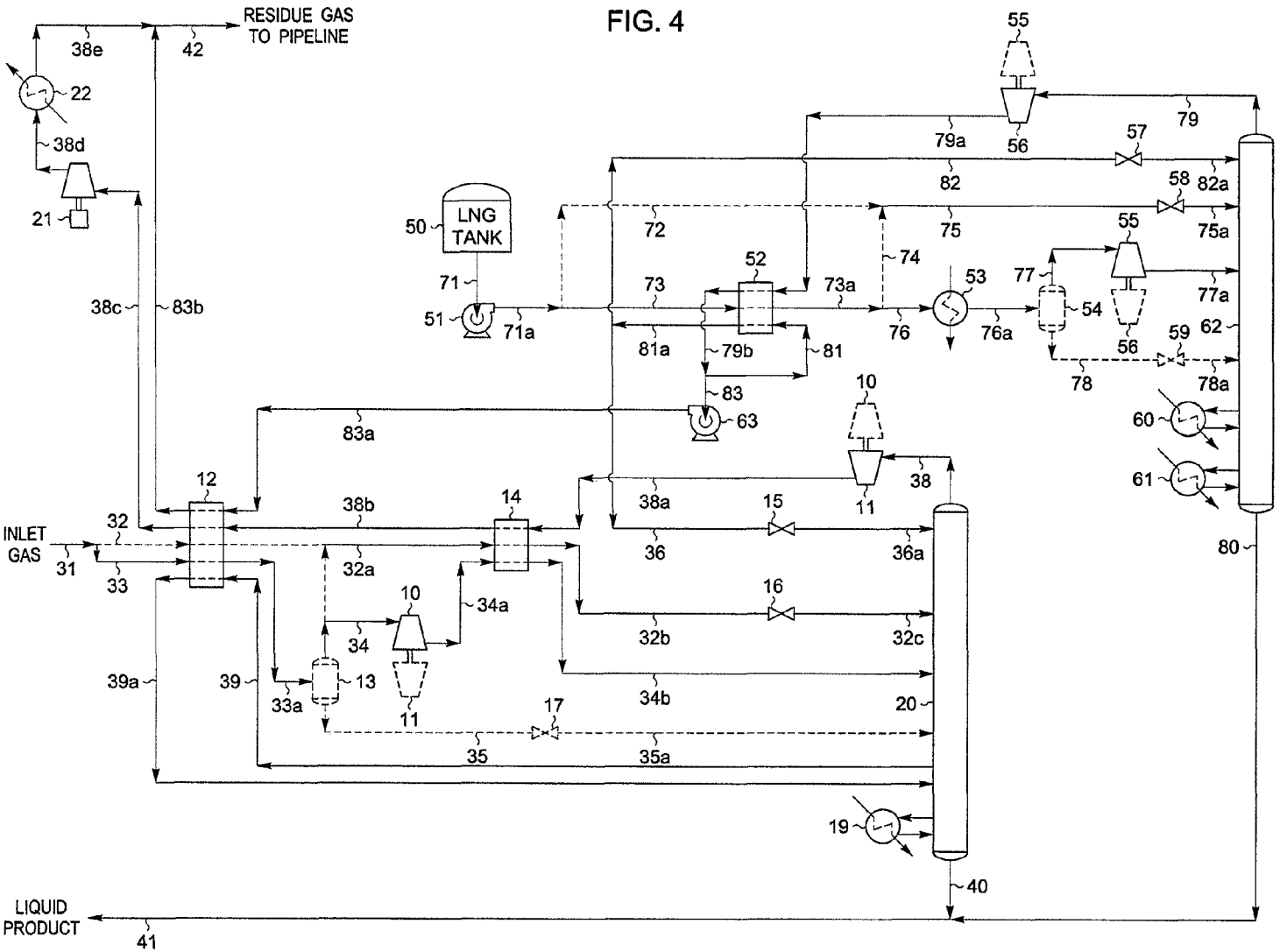
FIGS. 4 through 8 are flow diagrams illustrating alternative means of application of the present invention to LNG and natural gas streams.

An alternative method of processing natural gas is shown in another embodiment of the present invention as illustrated in FIG. 4. The LNG stream and inlet gas stream compositions and conditions considered in the process presented in FIG. 4 are the same as those in FIGS. 1 through 3. Accordingly, the FIG. 4 process can be compared with the FIGS. 1 and 2 processes to illustrate the advantages of the present invention, and can likewise be compared to the embodiment displayed in FIG. 3.

In the simulation of the FIG. 4 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,401 kPa(a)] and is split into two portions, streams 72 and 73. The first portion, stream 72, becomes stream 75 and is expanded to the operating pressure (approximately 415 psia [2,859 kPa(a)]) of fractionation column 62 by expansion valve 58. The expanded stream 75*a* leaves expansion valve 58 at −238° F. [−150° C.] and is thereafter supplied to tower 62 at an upper mid-column feed point.

The second portion, stream 73, is heated prior to entering separator 54 so that all or a portion of it is vaporized. In the example shown in FIG. 4, stream 73 is first heated to −77° F. [−61° C.] in heat exchanger 52 by cooling compressed overhead distillation stream 79*a* at −70° F. [−57° C.] and reflux stream 81 at −115° F. [−82° C.]. The partially heated stream 73*a* becomes stream 76 and is further heated in heat exchanger 53 using low level utility heat. The heated stream 76*a* enters separator 54 at −5° F. [−20° C.] and 1334 psia [9,195 kPa(a)] where the vapor (stream 77) is separated from any remaining liquid (stream 78). Vapor stream 77 enters a work expansion machine 55 in which mechanical energy is extracted from this portion of the high pressure feed. The machine 55 expands the vapor substantially isentropically to the tower operating pressure, with the work expansion cooling the expanded stream 77*a* to a temperature of approximately −107° F. [−77° C.]. The partially condensed expanded stream 77*a* is thereafter supplied as feed to fractionation column 62 at a lower mid-column feed point. The separator liquid (stream 78), if any, is expanded to the operating pressure of fractionation column 62 by expansion valve 59 before expanded stream 78*a* is supplied to fractionation tower 62 at a second lower mid-column feed point.

The column liquid stream 80 exits the bottom of the tower at 54° F. [12° C.], based on a typical specification of a methane to ethane ratio of 0.020:1 on a molar basis in the bottom product. Overhead distillation stream 79 is withdrawn from the upper section of fractionation tower 62 at −144° F. [−98° C.] and flows to compressor 56 driven by expansion machine 55, where it is compressed to 805 psia [5,554 kPa(a)] (stream 79*a*). At this pressure, the stream is totally condensed as it is cooled to −115° F. [−82° C.] in heat exchanger 52 as described previously. The condensed liquid (stream 79*b*) is then divided into two portions, streams 83 and 81. The first portion (stream 83) is the methane-rich lean LNG stream, which is pumped by pump 63 to 1270 psia [8,756 kPa(a)] for subsequent vaporization in heat exchanger 12, heating stream 83*a* to 40° F. [4° C.] as described below to produce warm lean LNG stream 83*b*.

The remaining portion of condensed liquid stream 79*b*, stream 81, flows to heat exchanger 52 where it is subcooled to −237° F. [−149° C.] by heat exchange with a portion of the cold LNG (stream 73) as described previously. The subcooled stream 81*a* is then divided into two portions, streams 82 and 36. The first portion, reflux stream 82, is expanded to the operating pressure of demethanizer 62 by expansion valve 57. The expanded stream 82*a* at −236° F. [−149° C.] is then supplied as cold top column feed (reflux) to demethanizer 62. This cold liquid reflux absorbs and condenses the $C_2$ components and heavier hydrocarbon components from the vapors rising in the upper rectification section of demethanizer 62. The disposition of the second portion, reflux stream 36 for demethanizer 20, is described below.

In the simulation of the FIG. 4 process, inlet gas enters the plant at 126° F. [52° C.] and 600 psia [4,137 kPa(a)] as stream 31. The feed stream 31 is divided into two portions, streams 32 and 33. The first portion, stream 32, is cooled in heat exchanger 12 by heat exchange with cold lean LNG (stream 83*a*) at −96° F. [−71° C.], cool compressed distillation stream 38*b* at −109° F. [−78° C.], and demethanizer liquids (stream 39) at −63° F. [−53° C.]. The partially cooled stream 32*a* is further cooled from −96° F. [−71° C.] to −121° F. [−85° C.] in heat exchanger 14 by heat exchange with cold compressed distillation stream 38*a* at −128° F. [−89° C.]. The substantially condensed stream 32*b* is then flash expanded through an appropriate expansion device, such as expansion valve 16, to the operating pressure (approximately 443 psia [3,052 kPa (a)]) of fractionation tower 20, cooling stream 32*c* to −129° F. [−90° C.] before it is supplied to fractionation tower 20 at an upper mid-column feed point.

The second portion of feed stream 31, stream 33, is cooled in heat exchanger 12 by heat exchange with cold lean LNG (stream 83*a*), cool compressed distillation stream 38*b*, and demethanizer liquids (stream 39) as described previously. The cooled stream 33*a* enters separator 13 at −86° F. [−65° C.] and 584 psia [4,027 kPa(a)] where the vapor (stream 34) is separated from the condensed liquid (stream 35). Liquid stream 35 is flash expanded through an appropriate expansion device, such as expansion valve 17, to the operating pressure of fractionation tower 20. The expanded stream 35*a* leaving expansion valve 17 reaches a temperature of −100° F. [−73° C.] and is supplied to fractionation tower 20 at a first lower mid-column feed point.

The vapor from separator 13 (stream 34) enters a work expansion machine 10 in which mechanical energy is extracted from this portion of the high pressure feed. The machine 10 expands the vapor substantially isentropically to slightly above the tower operating pressure, with the work expansion cooling the expanded stream 34*a* to a temperature of approximately −106° F. [−77° C.]. The expanded stream 34*a* is further cooled to −121° F. [−85° C.] in heat exchanger 14 by heat exchange with cold compressed distillation stream 38*a* as described previously, whereupon the partially condensed expanded stream 34*b* is thereafter supplied to fractionation tower 20 at a second lower mid-column feed point.

The second portion of subcooled stream 81*a*, reflux stream 36, is expanded to the operating pressure of demethanizer 20 by expansion valve 15. The expanded stream 36*a* at −236° F. [−149° C.] is then supplied as cold top column feed (reflux) to demethanizer 20. This cold liquid reflux absorbs and condenses the $C_2$ components and heavier hydrocarbon components from the vapors rising in the upper rectification section of demethanizer 20.

The column liquid stream 40 exits the bottom of the tower at 102° F. [39° C.], based on a typical specification of a methane to ethane ratio of 0.020:1 on a molar basis in the bottom product, and combines with stream 80 to form the liquid product (stream 41). Overhead distillation stream 38 is withdrawn from the upper section of fractionation tower 20 at −141° F. [−96° C.] and flows to compressor 11 driven by expansion machine 10, where it is compressed to 501 psia [3,452 kPa(a)]. The cold compressed distillation stream 38*a* passes countercurrently to the first portion (stream 32*a*) of inlet gas stream 31 and expanded vapor stream 34*a* in heat exchanger 14 where it is heated to −109° F. [−78° C.] (stream 38*b*), and countercurrently to the first portion (stream 32) and second portion (stream 33) of inlet gas stream 31 in heat exchanger 12 where it is heated to 31° F. [−1° C.] (stream 38*c*). The heated distillation stream then enters compressor 21 driven by a supplemental power source which compresses stream 38*c* to sales line pressure (stream 38*d*). After cooling to 126° F. [52° C.] in discharge cooler 22, stream 38*e* combines with warm lean LNG stream 83*b* to form the residue gas product (stream 42). Residue gas stream 42 flows to the sales gas pipeline at 1262 psia [8,701 kPa(a)], sufficient to meet line requirements.

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 32 | 3,404 | 404 | 238 | 133 | 4,251 |
| 33 | 39,141 | 4,644 | 2,734 | 1,525 | 48,894 |
| 34 | 28,606 | 1,181 | 191 | 26 | 30,730 |

TABLE IV-continued (FIG. 4)
Stream Flow Summary - Lb. Moles/Hr [kg moles/Hr]

| | | | | | |
|---|---|---|---|---|---|
| 35 | 10,535 | 3,463 | 2,543 | 1,499 | 18,164 |
| 36 | 8,046 | 2 | 0 | 0 | 8,101 |
| 38 | 50,491 | 27 | 0 | 0 | 51,413 |
| 40 | 100 | 5,023 | 2,972 | 1,658 | 9,833 |
| 71 | 40,293 | 2,642 | 491 | 3 | 43,689 |
| 72/75 | 4,916 | 322 | 60 | 0 | 5,330 |
| 73/76 | 35,377 | 2,320 | 431 | 3 | 38,359 |
| 77 | 35,377 | 2,320 | 431 | 3 | 38,359 |
| 78 | 0 | 0 | 0 | 0 | 0 |
| 79 | 45,682 | 14 | 0 | 0 | 45,990 |
| 81 | 13,488 | 4 | 0 | 0 | 13,579 |
| 83 | 32,194 | 10 | 0 | 0 | 32,411 |
| 82 | 5,442 | 2 | 0 | 0 | 5,478 |
| 80 | 53 | 2,630 | 491 | 3 | 3,177 |
| 42 | 82,685 | 37 | 0 | 0 | 83,824 |
| 41 | 153 | 7,653 | 3,463 | 1,661 | 13,010 |

| | | |
|---|---|---|
| Recoveries* | | |
| Ethane | 99.51% | |
| Propane | 100.00% | |
| Butanes+ | 100.00% | |
| Power | | |
| LNG Feed Pump | 3,561 HP | [5,854 kW] |
| LNG Product Pump | 1,727 HP | [2,839 kW] |
| Residue Gas Compressor | 24,400 HP | [40,113 kW] |
| Totals | 29,688 HP | [48,806 kW] |
| Low Level Utility Heat | | |
| Liquid Feed Heater | 65,000 MBTU/Hr | [41,987 kW] |
| Demethanizer Reboiler 60 | 19,000 MBTU/Hr | [12,273 kW] |
| Totals | 84,000 MBTU/Hr | [54,260 kW] |
| High Level Utility Heat | | |
| Demethanizer Reboiler 19 | 37,360 MBTU/Hr | [24,133 kW] |
| Demethanizer Reboiler 61 | 8,400 MBTU/Hr | [5,426 kW] |
| Totals | 45,760 MBTU/Hr | [29,559 kW] |
| Specific Power | | |
| HP-Hr/Lb. Mole [kW-Hr/kg mole] | 2.282 | [3.751] |

*(Based on un-rounded flow rates)

A comparison of Tables III and IV shows that the FIG. 4 embodiment of the present invention achieves essentially the same liquids recovery as the FIG. 3 embodiment. However, the FIG. 4 embodiment uses less power than the FIG. 3 embodiment, improving the specific power by slightly more than 1%. In addition, the high level utility heat required for the FIG. 4 embodiment of the present invention is about 8% less than that of the FIG. 3 embodiment.

Example 3

Figure 5:
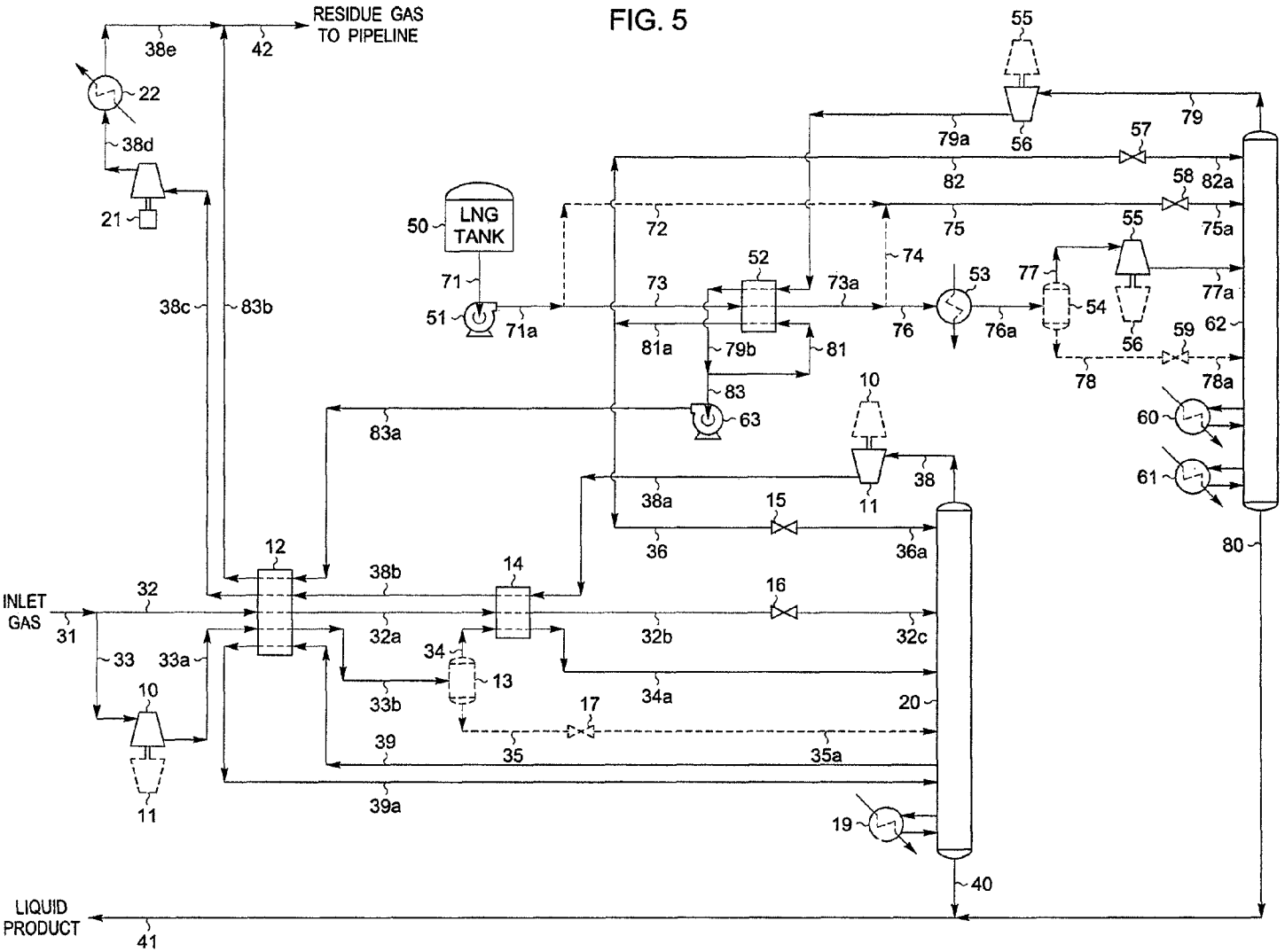

Another alternative method of processing natural gas is shown in the embodiment of the present invention as illustrated in FIG. 5. The LNG stream and inlet gas stream compositions and conditions considered in the process presented in FIG. 5 are the same as those in FIGS. 1 through 4. Accordingly, the FIG. 5 process can be compared with the FIGS. 1 and 2 processes to illustrate the advantages of the present invention, and can likewise be compared to the embodiments displayed in FIGS. 3 and 4.

In the simulation of the FIG. 5 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,401 kPa(a)] and is split into two portions, streams 72 and 73. The first portion, stream 72, becomes stream 75 and is expanded to the operating pressure (approximately 415 psia [2,859 kPa(a)]) of fractionation column 62 by expansion valve 58. The expanded stream 75*a* leaves expansion valve 58 at −238° F. [−150° C.] and is thereafter supplied to tower 62 at an upper mid-column feed point.

The second portion, stream 73, is heated prior to entering separator 54 so that all or a portion of it is vaporized. In the example shown in FIG. 5, stream 73 is first heated to −77° F. [−61° C.] in heat exchanger 52 by cooling compressed overhead distillation stream 79*a* at −70° F. [−57° C.] and reflux stream 81 at −112° F. [−80° C.]. The partially heated stream 73*a* becomes stream 76 and is further heated in heat exchanger 53 using low level utility heat. The heated stream 76*a* enters separator 54 at −5° F. [−20° C.] and 1334 psia [9,195 kPa(a)] where the vapor (stream 77) is separated from any remaining liquid (stream 78). Vapor stream 77 enters a work expansion machine 55 in which mechanical energy is extracted from this portion of the high pressure feed. The machine 55 expands the vapor substantially isentropically to the tower operating pressure, with the work expansion cooling the expanded stream 77*a* to a temperature of approximately −107° F. [−77° C.]. The partially condensed expanded stream 77*a* is thereafter supplied as feed to fractionation column 62 at a lower mid-column feed point. The separator liquid (stream 78), if any, is expanded to the operating pressure of fractionation column 62 by expansion valve 59 before expanded stream 78*a* is supplied to fractionation tower 62 at a second lower mid-column feed point.

The column liquid stream 80 exits the bottom of the tower at 54° F. [12° C.], based on a typical specification of a methane to ethane ratio of 0.020:1 on a molar basis in the bottom product. Overhead distillation stream 79 is withdrawn from the upper section of fractionation tower 62 at −144° F. [−98° C.] and flows to compressor 56 driven by expansion machine 55, where it is compressed to 805 psia [5,554 kPa(a)] (stream 79*a*). At this pressure, the stream is totally condensed as it is cooled to −112° F. [−80° C.] in heat exchanger 52 as described previously. The condensed liquid (stream 79*b*) is then divided into two portions, streams 83 and 81. The first portion (stream 83) is the methane-rich lean LNG stream, which is pumped by pump 63 to 1270 psia [8,756 kPa(a)] for subsequent vaporization in heat exchanger 12, heating stream 83*a* to 40° F. [4° C.] as described below to produce warm lean LNG stream 83*b*.

The remaining portion of condensed liquid stream 79*b*, stream 81, flows to heat exchanger 52 where it is subcooled to −237° F. [−149° C.] by heat exchange with a portion of the cold LNG (stream 73) as described previously. The subcooled stream 81*a* is then divided into two portions, streams 82 and 36. The first portion, reflux stream 82, is expanded to the operating pressure of demethanizer 62 by expansion valve 57. The expanded stream 82*a* at −236° F. [−149° C.] is then supplied as cold top column feed (reflux) to demethanizer 62. This cold liquid reflux absorbs and condenses the $C_2$ components and heavier hydrocarbon components from the vapors rising in the upper rectification section of demethanizer 62. The disposition of the second portion, reflux stream 36 for demethanizer 20, is described below.

In the simulation of the FIG. 5 process, inlet gas enters the plant at 126° F. [52° C.] and 600 psia [4,137 kPa(a)] as stream 31. The feed stream 31 is divided into two portions, streams 32 and 33. The first portion, stream 32, is cooled in heat exchanger 12 by heat exchange with cold lean LNG (stream 83*a*) at −89° F. [−67° C.], cool compressed distillation stream 38*b* at −91° F. [−68° C.], and demethanizer liquids (stream 39) at −89° F. [−67° C.]. The partially cooled stream 32*a* is further cooled from −86° F. [−65° C.] to −100° F. [−74° C.] in heat exchanger 14 by heat exchange with cold compressed distillation stream 38*a* at −112° F. [−80° C.]. The substantially condensed stream 32*b* is then flash expanded through an appropriate expansion device, such as expansion valve 16, to the operating pressure (approximately 428 psia [2,949 kPa (a)]) of fractionation tower 20, cooling stream 32*c* to −117° F. [−83° C.] before it is supplied to fractionation tower 20 at an upper mid-column feed point.

The second portion of feed stream 31, stream 33, enters a work expansion machine 10 in which mechanical energy is extracted from this portion of the high pressure feed. The machine 10 expands the vapor substantially isentropically to a pressure slightly above the operating pressure of fractionation tower 20, with the work expansion cooling the expanded stream 33*a* to a temperature of approximately 95° F. [35° C.]. The expanded stream 33*a* is further cooled in heat exchanger 12 by heat exchange with cold lean LNG (stream 83*a*), cool compressed distillation stream 38*b*, and demethanizer liquids (stream 39) as described previously. The further cooled stream 33*b* enters separator 13 at −85° F. [−65° C.] and 436 psia [3,004 kPa(a)] where the vapor (stream 34) is separated from the condensed liquid (stream 35).

Vapor stream 34 is cooled to −100° F. [−74° C.] in heat exchanger 14 by heat exchange with cold compressed distillation stream 38*a* as described previously. The partially condensed stream 34*a* is then supplied to fractionation tower 20 at a first lower mid-column feed point. Liquid stream 35 is flash expanded through an appropriate expansion device, such as expansion valve 17, to the operating pressure of fractionation tower 20. The expanded stream 35*a* leaving expansion valve 17 reaches a temperature of −86° F. [−65° C.] and is supplied to fractionation tower 20 at a second lower mid-column feed point.

The second portion of subcooled stream 81*a*, reflux stream 36, is expanded to the operating pressure of demethanizer 20 by expansion valve 15. The expanded stream 36*a* at −236° F. [−149° C.] is then supplied as cold top column feed (reflux) to demethanizer 20. This cold liquid reflux absorbs and condenses the $C_2$ components and heavier hydrocarbon components from the vapors rising in the upper rectification section of demethanizer 20.

The column liquid stream 40 exits the bottom of the tower at 98° F. [37° C.], based on a typical specification of a methane to ethane ratio of 0.020:1 on a molar basis in the bottom product, and combines with stream 80 to form the liquid product (stream 41). Overhead distillation stream 38 is withdrawn from the upper section of fractionation tower 20 at −143° F. [−97° C.] and flows to compressor 11 driven by expansion machine 10, where it is compressed to 573 psia [3,950 kPa(a)]. The cold compressed distillation stream 38*a* passes countercurrently to the first portion (stream 32*a*) of inlet gas stream 31 and vapor stream 34 in heat exchanger 14 where it is heated to −91° F. [−68° C.] (stream 38*b*), and countercurrently to the first portion (stream 32) and expanded second portion (stream 33*a*) of inlet gas stream 31 in heat exchanger 12 where it is heated to 67° F. [19° C.] (stream 38*c*). The heated distillation stream then enters compressor 21 driven by a supplemental power source which compresses stream 38*c* to sales line pressure (stream 38*d*). After cooling to 126° F. [52° C.] in discharge cooler 22, stream 38*e* combines with warm lean LNG stream 83*b* to form the residue gas product (stream 42). Residue gas stream 42 flows to the sales gas pipeline at 1262 psia [8,701 kPa(a)], sufficient to meet line requirements.

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 32 | 14,465 | 1,716 | 1,010 | 564 | 18,069 |
| 33 | 28,080 | 3,332 | 1,962 | 1,094 | 35,076 |
| 34 | 24,317 | 1,236 | 184 | 21 | 26,322 |
| 35 | 3,763 | 2,096 | 1,778 | 1,073 | 8,754 |
| 36 | 10,372 | 3 | 0 | 0 | 10,442 |
| 38 | 52,817 | 30 | 0 | 0 | 53,749 |
| 40 | 100 | 5,021 | 2,972 | 1,658 | 9,838 |
| 71 | 40,293 | 2,642 | 491 | 3 | 43,689 |
| 72/75 | 4,916 | 322 | 60 | 0 | 5,330 |
| 73/76 | 35,377 | 2,320 | 431 | 3 | 38,359 |
| 77 | 35,377 | 2,320 | 431 | 3 | 38,359 |
| 78 | 0 | 0 | 0 | 0 | 0 |
| 79 | 45,682 | 14 | 0 | 0 | 45,990 |
| 81 | 15,814 | 5 | 0 | 0 | 15,920 |
| 83 | 29,868 | 9 | 0 | 0 | 30,070 |
| 82 | 5,442 | 2 | 0 | 0 | 5,478 |
| 80 | 53 | 2,630 | 491 | 3 | 3,177 |
| 42 | 82,685 | 39 | 0 | 0 | 83,819 |
| 41 | 153 | 7,651 | 3,463 | 1,661 | 13,015 |

| Recoveries* | | |
|---|---|---|
| Ethane | 99.48% | |
| Propane | 100.00% | |
| Butanes+ | 100.00% | |
| **Power** | | |
| LNG Feed Pump | 3,561 HP | [5,854 kW] |
| LNG Product Pump | 1,778 HP | [2,923 kW] |
| Residue Gas Compressor | 23,201 HP | [38,142 kW] |
| Totals | 28,540 HP | [46,919 kW] |
| **Low Level Utility Heat** | | |
| Liquid Feed Heater | 65,000 MBTU/Hr | [41,987 kW] |
| Demethanizer Reboiler 60 | 19,000 MBTU/Hr | [12,273 kW] |
| Totals | 84,000 MBTU/Hr | [54,260 kW] |
| **High Level Utility Heat** | | |
| Demethanizer Reboiler 19 | 53,370 MBTU/Hr | [34,475 kW] |
| Demethanizer Reboiler 61 | 8,400 MBTU/Hr | [5,426 kW] |
| Totals | 61,770 MBTU/Hr | [39,901 kW] |
| **Specific Power** | | |
| HP-Hr/Lb. Mole [kW-Hr/kg mole] | 2.193 | [3.605] |

*(Based on un-rounded flow rates)

A comparison of Tables III, IV, and V shows that the FIG. 5 embodiment of the present invention achieves essentially the same liquids recovery as the FIG. 3 and FIG. 4 embodiments. The FIG. 5 embodiment uses less power than the FIG. 3 and FIG. 4 embodiments, improving the specific power by over 5% relative to the FIG. 3 embodiment and nearly 4% relative to the FIG. 4 embodiment. However, the high level utility heat required for the FIG. 5 embodiment of the present invention is somewhat higher than that of the FIG. 3 and FIG. 4 embodiments (by 24% and 35%, respectively). The choice of which embodiment to use for a particular application will generally be dictated by the relative costs of power and high level utility heat and the relative capital costs of pumps, heat exchangers, and compressors.

Example 4

Figure 6:
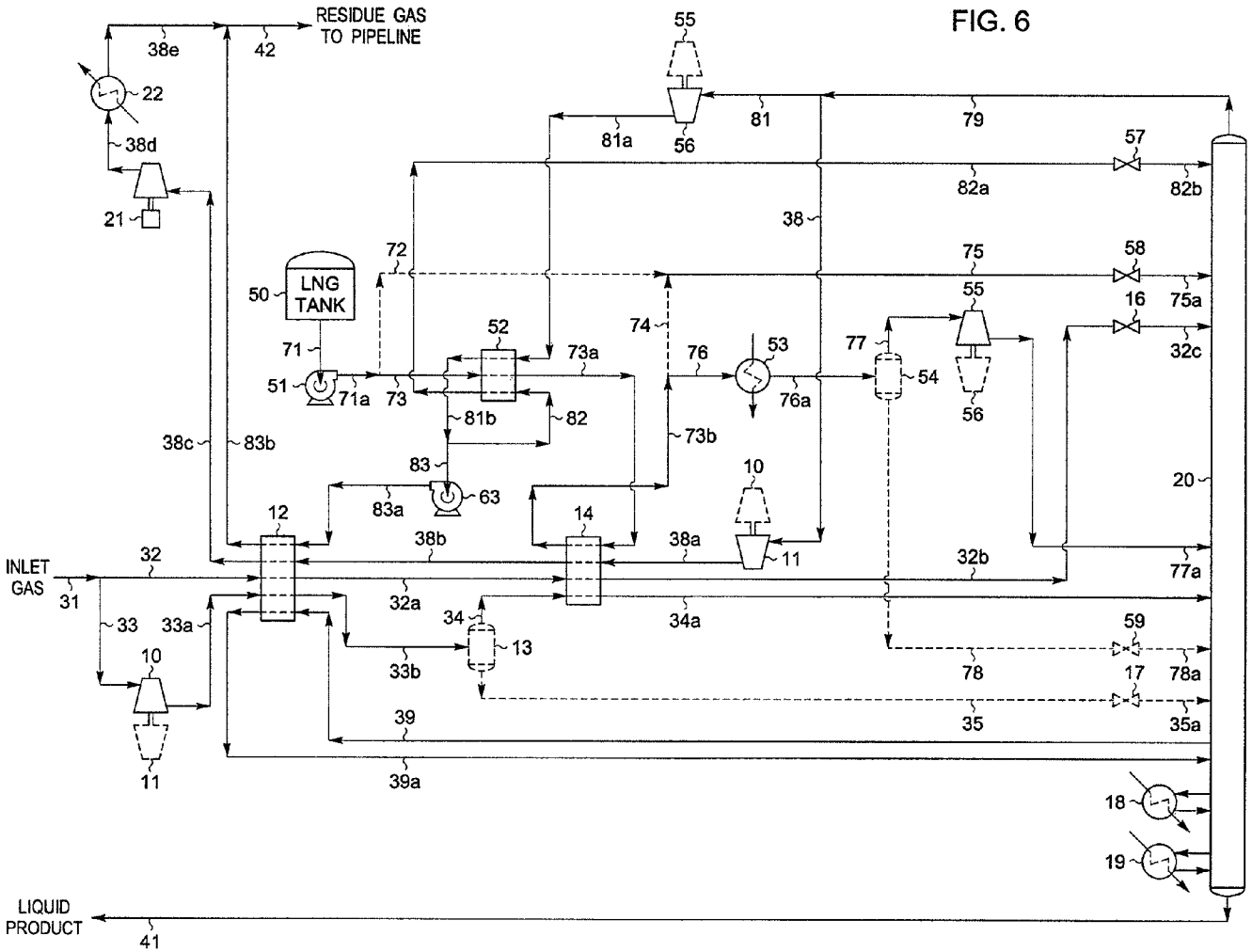

An alternative method of processing LNG and natural gas is shown in the embodiment of the present invention as illustrated in FIG. 6. The LNG stream and inlet gas stream compositions and conditions considered in the process presented in FIG. 6 are the same as those in FIGS. 1 through 5. Accordingly, the FIG. 5 process can be compared with the FIGS. 1 and 2 processes to illustrate the advantages of the present invention, and can likewise be compared to the embodiments displayed in FIGS. 3 through 5.

In the simulation of the FIG. 6 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,401 kPa(a)] and is split into two portions, streams 72 and 73. The first portion, stream 72, becomes stream 75 and is expanded to the operating pressure (approximately 435 psia [2,997 kPa(a)]) of fractionation column 20 by expansion valve 58. The expanded stream 75*a* leaves expansion valve 58 at −238° F. [−150° C.] and is thereafter supplied to tower 20 at a first upper mid-column feed point.

The second portion, stream 73, is heated prior to entering separator 54 so that all or a portion of it is vaporized. In the example shown in FIG. 6, stream 73 is first heated to −76° F. [−60° C.] in heat exchanger 52 by cooling compressed overhead distillation stream 81*a* at −65° F. [−54° C.] and reflux stream 82 at −117° F. [−82° C.], then heated in heat exchanger 14 as described below. The partially heated stream 73*b* becomes stream 76 and is further heated in heat exchanger 53 using low level utility heat. The heated stream 76*a* enters separator 54 at −5° F. [−20° C.] and 1334 psia [9,195 kPa(a)] where the vapor (stream 77) is separated from any remaining liquid (stream 78). Vapor stream 77 enters a work expansion machine 55 in which mechanical energy is extracted from this portion of the high pressure feed. The machine 55 expands the vapor substantially isentropically to the tower operating pressure, with the work expansion cooling the expanded stream 77*a* to a temperature of approximately −104° F. [−76° C.]. The partially condensed expanded stream 77*a* is thereafter supplied as feed to fractionation column 20 at a first lower mid-column feed point. The separator liquid (stream 78), if any, is expanded to the operating pressure of fractionation column 20 by expansion valve 59 before expanded stream 78*a* is supplied to fractionation tower 20 at a second lower mid-column feed point.

In the simulation of the FIG. 6 process, inlet gas enters the plant at 126° F. [52° C.] and 600 psia [4,137 kPa(a)] as stream 31. The feed stream 31 is divided into two portions, streams 32 and 33. The first portion, stream 32, is cooled in heat exchanger 12 by heat exchange with cold lean LNG (stream 83*a*) at −103° F. [−75° C.], cool compressed distillation stream 38*b* at −92° F. [−69° C.], and demethanizer liquids (stream 39) at −78° F. [−61° C.]. The partially cooled stream 32*a* is further cooled from −94° F. [−70° C.] to −101° F. [−74° C.] in heat exchanger 14 by heat exchange with the partially heated second portion (stream 73*a*) of the LNG stream and with cold compressed distillation stream 38*a* at −106° F. [−77° C.]. The substantially condensed stream 32*b* is then flash expanded through an appropriate expansion device, such as expansion valve 16, to the operating pressure of fractionation tower 20, cooling stream 32*c* to −117° F. [−83° C.] before it is supplied to fractionation tower 20 at a second upper mid-column feed point.

The second portion of feed stream 31, stream 33, enters a work expansion machine 10 in which mechanical energy is extracted from this portion of the high pressure feed. The machine 10 expands the vapor substantially isentropically to a pressure slightly above the operating pressure of fractionation tower 20, with the work expansion cooling the expanded stream 33*a* to a temperature of approximately 96° F. [36° C.]. The expanded stream 33*a* is further cooled in heat exchanger 12 by heat exchange with cold lean LNG (stream 83*a*), cool compressed distillation stream 38*b*, and demethanizer liquids (stream 39) as described previously. The further cooled stream 33*b* enters separator 13 at −90° F. [−68° C.] and 443 psia [3,052 kPa(a)] where the vapor (stream 34) is separated from the condensed liquid (stream 35).

Vapor stream 34 is cooled to −101° F. [−74° C.] in heat exchanger 14 by heat exchange with the partially heated second portion (stream 73*a*) of the LNG stream and with cold compressed distillation stream 38*a* as described previously. The partially condensed stream 34*a* is then supplied to fractionation tower 20 at a third lower mid-column feed point. Liquid stream 35 is flash expanded through an appropriate expansion device, such as expansion valve 17, to the operating pressure of fractionation tower 20. The expanded stream 35*a* leaving expansion valve 17 reaches a temperature of −90° F. [−68° C.] and is supplied to fractionation tower 20 at a fourth lower mid-column feed point.

The liquid product stream 41 exits the bottom of the tower at 89° F. [32° C.], based on a typical specification of a methane to ethane ratio of 0.020:1 on a molar basis in the bottom product. Overhead distillation stream 79 is withdrawn from the upper section of fractionation tower 20 at −142° F. [−97° C.] and is divided into two portions, stream 81 and stream 38. The first portion (stream 81) flows to compressor 56 driven by expansion machine 55, where it is compressed to 864 psia [5,955 kPa(a)] (stream 81*a*). At this pressure, the stream is totally condensed as it is cooled to −117° F. [−83° C.] in heat exchanger 52 as described previously. The condensed liquid (stream 81*b*) is then divided into two portions, streams 83 and 82. The first portion (stream 83) is the methane-rich lean LNG stream, which is pumped by pump 63 to 1270 psia [8,756 kPa(a)] for subsequent vaporization in heat exchanger 12, heating stream 83*a* to 40° F. [4° C.] as described previously to produce warm lean LNG stream 83*b*.

The remaining portion of stream 81*b* (stream 82) flows to heat exchanger 52 where it is subcooled to −237° F. [−149° C.] by heat exchange with a portion of the cold LNG (stream 73) as described previously. The subcooled stream 82*a* is expanded to the operating pressure of fractionation column 20 by expansion valve 57. The expanded stream 82*b* at −236° F. [−149° C.] is then supplied as cold top column feed (reflux) to demethanizer 20. This cold liquid reflux absorbs and condenses the $C_2$ components and heavier hydrocarbon components from the vapors rising in the upper rectification section of demethanizer 20.

The second portion of distillation stream 79 (stream 38) flows to compressor 11 driven by expansion machine 10, where it is compressed to 604 psia [4,165 kPa(a)]. The cold compressed distillation stream 38*a* passes countercurrently to the first portion (stream 32*a*) of inlet gas stream 31 and vapor stream 34 in heat exchanger 14 where it is heated to −92° F. [−69° C.] (stream 38*b*), and countercurrently to the first portion (stream 32) and expanded second portion (stream 33*a*) of inlet gas stream 31 in heat exchanger 12 where it is heated to 48° F. [9° C.] (stream 38*c*). The heated distillation stream then enters compressor 21 driven by a supplemental power source which compresses stream 38*c* to sales line pressure (stream 38*d*). After cooling to 126° F. [52° C.] in discharge cooler 22, stream 38*e* combines with warm lean LNG stream 83*b* to form the residue gas product (stream 42). Residue gas stream 42 flows to the sales gas pipeline at 1262 psia [8,701 kPa(a)], sufficient to meet line requirements.

A summary of stream flow rates and energy consumption for the process illustrated in FIG. 6 is set forth in the following table:

TABLE VI (FIG. 6)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 32 | 7,871 | 934 | 550 | 307 | 9,832 |
| 33 | 34,674 | 4,114 | 2,422 | 1,351 | 43,313 |
| 34 | 29,159 | 1,328 | 185 | 21 | 31,380 |
| 35 | 5,515 | 2,786 | 2,237 | 1,330 | 11,933 |
| 71 | 40,293 | 2,642 | 491 | 3 | 43,689 |
| 72/75 | 5,037 | 330 | 61 | 0 | 5,461 |
| 73/76 | 35,256 | 2,312 | 430 | 3 | 38,228 |
| 77 | 35,256 | 2,312 | 430 | 3 | 38,228 |
| 78 | 0 | 0 | 0 | 0 | 0 |
| 79 | 97,329 | 46 | 0 | 0 | 98,696 |
| 38 | 54,991 | 26 | 0 | 0 | 55,763 |
| 81 | 42,338 | 20 | 0 | 0 | 42,933 |
| 82 | 14,644 | 7 | 0 | 0 | 14,850 |
| 83 | 27,694 | 13 | 0 | 0 | 28,083 |
| 42 | 82,685 | 39 | 0 | 0 | 83,846 |
| 41 | 153 | 7,651 | 3,463 | 1,661 | 12,988 |

| Recoveries* | | |
|---|---|---|
| Ethane | 99.48% | |
| Propane | 100.00% | |
| Butanes+ | 100.00% | |
| **Power** | | |
| LNG Feed Pump | 3,561 HP | [5,854 kW] |
| LNG Product Pump | 1,216 HP | [1,999 kW] |
| Residue Gas Compressor | 21,186 HP | [34,829 kW] |
| Totals | 25,963 HP | [42,682 kW] |
| **Low Level Utility Heat** | | |
| Liquid Feed Heater | 70,000 MBTU/Hr | [45,217 kW] |
| Demethanizer Reboiler 18 | 30,000 MBTU/Hr | [19,378 kW] |
| Totals | 100,000 MBTU/Hr | [64,595 kW] |
| **High Level Utility Heat** | | |
| Demethanizer Reboiler 19 | 39,180 MBTU/Hr | [25,308 kW] |
| **Specific Power** | | |
| HP-Hr/Lb. Mole [kW-Hr/kg mole] | 1.999 | [3.286] |

*(Based on un-rounded flow rates)

A comparison of Tables III, IV, V, and VI shows that the FIG. 6 embodiment of the present invention achieves essentially the same liquids recovery as the FIGS. 3, 4, and 5 embodiments. However, the reduction in the energy consumption of the FIG. 6 embodiment of the present invention relative to the embodiments in FIGS. 3 through 5 is unexpectedly large. The FIG. 6 embodiment uses less power than the FIGS. 3, 4, and 5 embodiments, reducing the specific power by 14%, 12%, and 9%, respectively. The high level utility heat required for the FIG. 6 embodiment of the present invention is also lower than that of the FIGS. 3, 4, and 5 embodiments (by 21%, 14%, and 37%, respectively). These large gains in process efficiency are mainly due to the more optimal distribution of the column feeds afforded by integrating the LNG processing and the natural gas processing into a single fractionation column, demethanizer 20. For instance, the relative distribution of the inlet gas stream 31 between stream 32 (which forms the substantially condensed expanded stream 32*c*) and stream 33 supplied to expansion machine 10 can be optimized for power production, since stream 75*a* from LNG stream 71 provides part of the supplemental rectification for column 20 that must be provided entirely by stream 32*c* in the FIGS. 3 through 5 embodiments.

The capital cost of the FIG. 6 embodiment of the present invention will generally be less than that of the FIGS. 3, 4, and 5 embodiments since it uses only one fractionation column, and due to the reduction in power and high level utility heat consumption. The choice of which embodiment to use for a particular application will generally be dictated by the relative costs of power and high level utility heat and the relative capital costs of columns, pumps, heat exchangers, and compressors.

Other Embodiments

Figure 7:
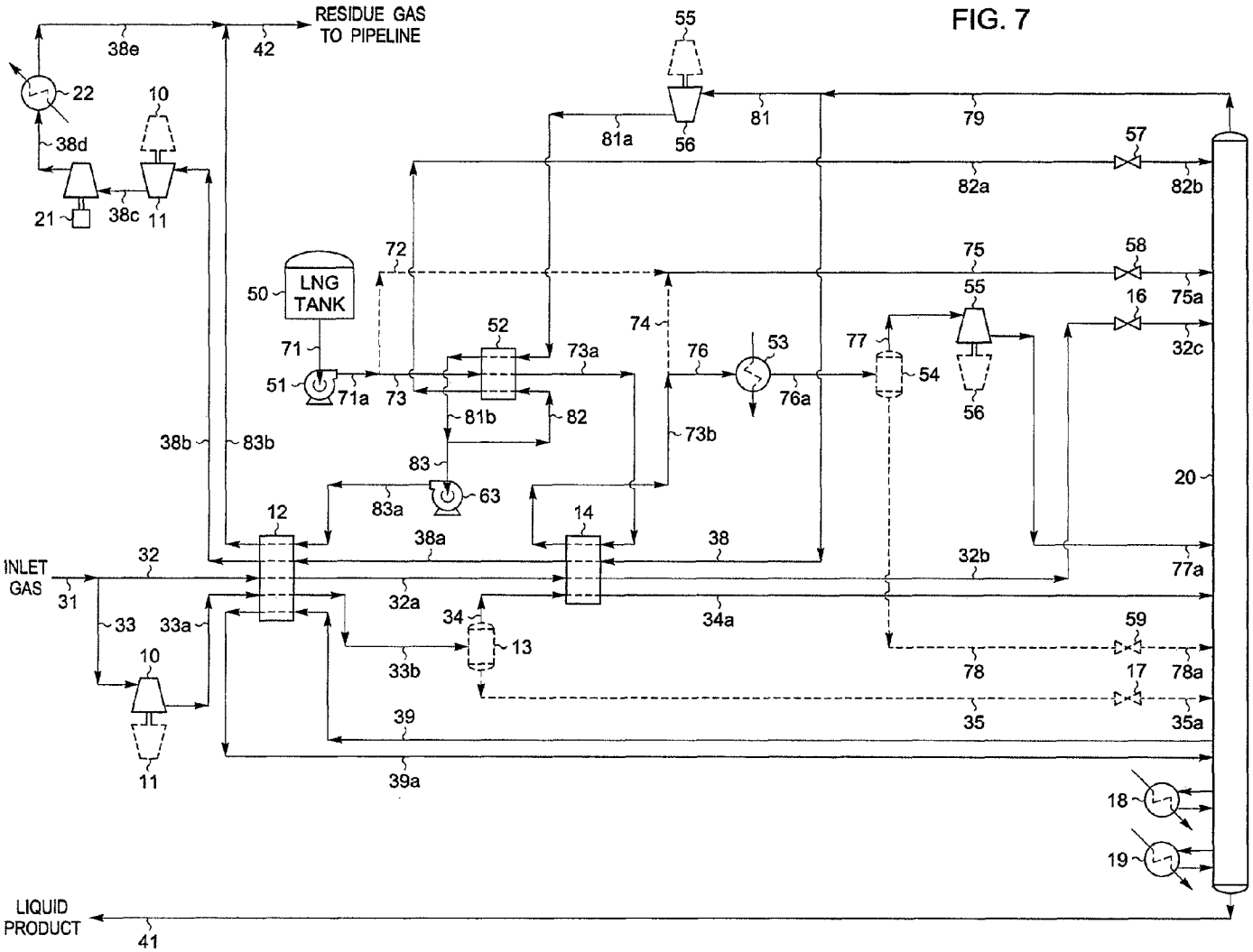

Some circumstances may favor using cold distillation stream 38 in the FIG. 6 embodiment for heat exchange prior to compression as shown in the embodiment displayed in FIG. 7. In other instances, work expansion of the high pressure inlet gas may be more advantageous after cooling and separation of any liquids, as shown in the embodiment displayed in FIG. 8. The choices regarding the streams used for work expansion and where best to apply the power generated in compressing the process streams will depend on such factors as inlet gas pressure and composition, and must be determined for each application.

When the inlet gas is leaner, separator 13 in FIGS. 3 through 8 may not be needed. Depending on the quantity of heavier hydrocarbons in the feed gas and the feed gas pressure, the cooled stream 33*b* (FIGS. 3, 5, 6, and 7) or cooled stream 33*a* (FIGS. 4 and 8) leaving heat exchanger 12 may not contain any liquid (because it is above its dewpoint, or because it is above its cricondenbar), so that separator 13 may not be justified. In such cases, separator 13 and expansion valve 17 may be eliminated as shown by the dashed lines. When the LNG to be processed is lean or when complete vaporization of the LNG in heat exchangers 52 and 53 is contemplated, separator 54 in FIGS. 3 through 8 may not be justified. Depending on the quantity of heavier hydrocarbons in the inlet LNG and the pressure of the LNG stream leaving feed pump 51, the heated LNG stream leaving heat exchanger 53 may not contain any liquid (because it is above its dewpoint, or because it is above its cricondenbar). In such cases, separator 54 and expansion valve 59 may be eliminated as shown by the dashed lines.

Figure 8:
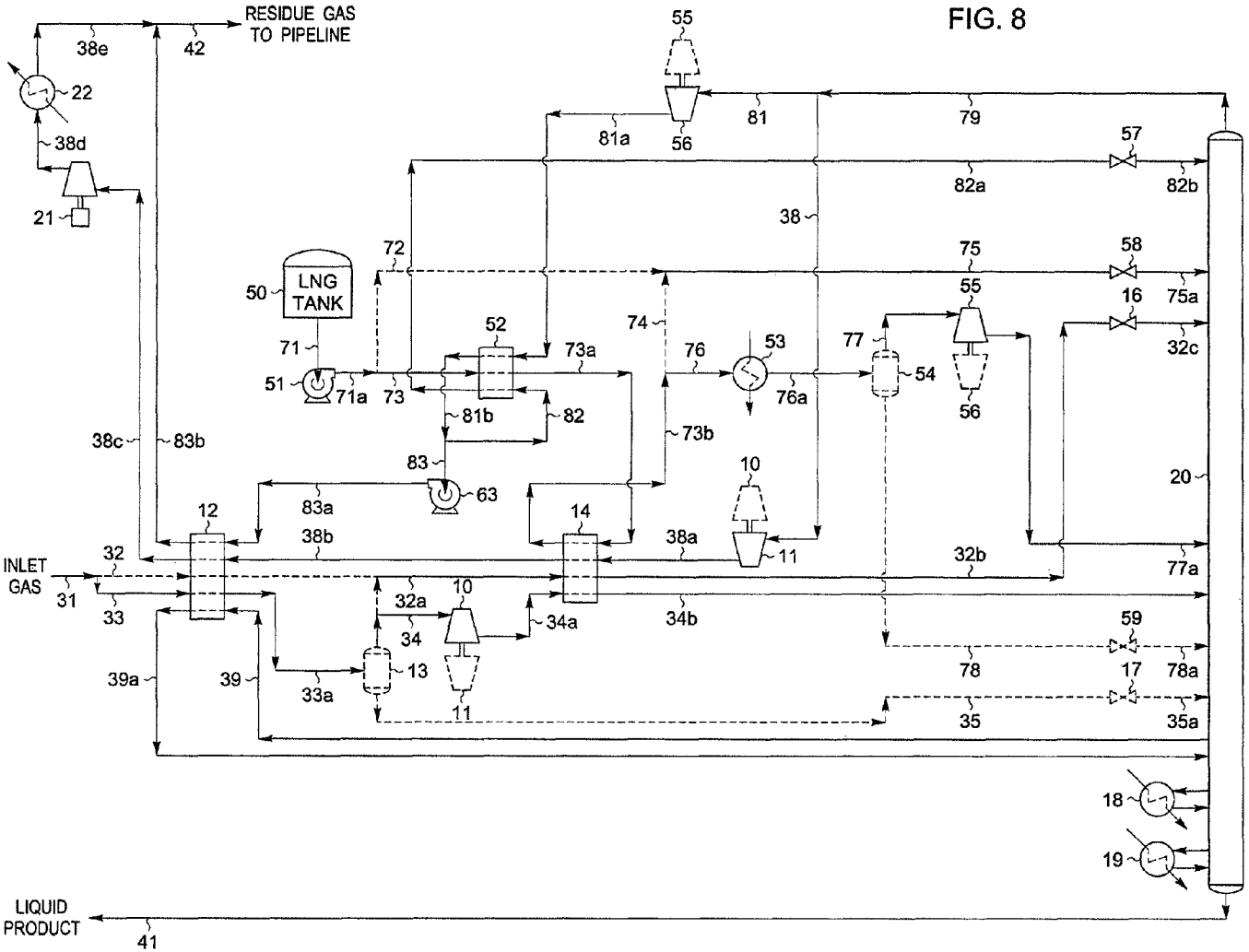

In the embodiments of the present invention illustrated in FIGS. 4 and 8, the expanded substantially condensed stream 32*c* is formed using a portion (stream 32) of inlet gas stream 31. Depending on the feed gas composition and other factors, some circumstances may favor using a portion of the vapor (stream 34) from separator 13 instead. In such instances, a portion of the separator 13 vapor forms stream 32*a* as shown by the dashed lines in FIGS. 4 and 8, with the remaining portion forming the stream 34 that is fed to expansion machine 10.

In the examples shown, total condensation of stream 79*b* in FIGS. 3 through 5 and stream 81*b* in FIGS. 6 through 8 is shown. Some circumstances may favor subcooling these streams, while other circumstances may favor only partial condensation. Should partial condensation of these streams be achieved, processing of the uncondensed vapor may be necessary, using a compressor or other means to elevate the pressure of the vapor so that it can join the pumped condensed liquid. Alternatively, the uncondensed vapor could be routed to the plant fuel system or other such use.

Feed gas conditions, LNG conditions, plant size, available equipment, or other factors may indicate that elimination of work expansion machines 10 and/or 55, or replacement with an alternate expansion device (such as an expansion valve), is feasible. Although individual stream expansion is depicted in particular expansion devices, alternative expansion means may be employed where appropriate.

In FIGS. 3 through 8, individual heat exchangers have been shown for most services. However, it is possible to combine two or more heat exchange services into a common heat exchanger, such as combining heat exchangers 12 and 14 in FIGS. 3 through 8 into a common heat exchanger. In some cases, circumstances may favor splitting a heat exchange service into multiple exchangers. The decision as to whether to combine heat exchange services or to use more than one heat exchanger for the indicated service will depend on a number of factors including, but not limited to, inlet gas flow rate, LNG flow rate, heat exchanger size, stream temperatures, etc. In accordance with the present invention, the use and distribution of the methane-rich lean LNG and tower overhead streams for process heat exchange, and the particular arrangement of heat exchangers for heating the LNG streams and cooling the feed gas streams, must be evaluated for each particular application, as well as the choice of process streams for specific heat exchange services.

In the embodiments of the present invention illustrated in FIGS. 3 through 8, lean LNG stream 83*a* is used directly to provide cooling in heat exchanger 12 or heat exchangers 12 and 14. However, some circumstances may favor using the lean LNG to cool an intermediate heat transfer fluid, such as propane or other suitable fluid, whereupon the cooled heat transfer fluid is then used to provide cooling in heat exchanger 12 or heat exchangers 12 and 14. This alternative means of indirectly using the refrigeration available in lean LNG stream 83*a* accomplishes the same process objectives as the direct use of stream 83*a* for cooling in the FIGS. 3 through 8 embodiments of the present invention. The choice of how best to use the lean LNG stream for refrigeration will depend mainly on the composition of the inlet gas, but other factors may affect the choice as well.

It will be recognized that the relative amount of feed found in each branch of the split LNG feed to fractionation column 62, in each branch of the split inlet gas to fractionation column 20, and in each branch of the split LNG feed and the split inlet gas to fractionation column 20 will depend on several factors, including inlet gas composition, LNG composition, the amount of heat which can economically be extracted from the feed, and the quantity of horsepower available. More feed to the top of the column may increase recovery while increasing the duty in reboilers 61 and/or 19 and thereby increasing the high level utility heat requirements. Increasing feed lower in the column reduces the high level utility heat consumption but may also reduce product recovery. The relative locations of the mid-column feeds may vary depending on inlet gas composition, LNG composition, or other factors such as the desired recovery level and the amount of vapor formed during heating of the LNG streams. Moreover, two or more of the feed streams, or portions thereof, may be combined depending on the relative temperatures and quantities of individual streams, and the combined stream then fed to a mid-column feed position.

In some circumstance it may be desirable to recover refrigeration from the portion (stream 75*a*) of LNG feed stream 71 that is fed to an upper mid-column feed point on demethanizer 62 (FIGS. 3 through 5) and demethanizer 20 (FIGS. 6 through 8). In such cases, all of stream 71*a* would be directed to heat exchanger 52 (stream 73) and the partially heated LNG stream (stream 73*a* in FIGS. 3 through 5 and stream 73*b* in FIGS. 6 through 8) would then be divided into stream 76 and stream 74 (as shown by the dashed lines), whereupon stream 74 would be directed to stream 75.

In the examples given for the FIGS. 3 through 6 embodiments, recovery of $C_2$ components and heavier hydrocarbon components is illustrated. However, it is believed that the FIGS. 3 through 8 embodiments are also advantageous when recovery of only $C_3$ components and heavier hydrocarbon components is desired. The present invention provides improved recovery of $C_2$ components and heavier hydrocarbon components or of $C_3$ components and heavier hydrocarbon components per amount of utility consumption required to operate the process. An improvement in utility consumption required for operating the process may appear in the form of reduced power requirements for compression or pumping, reduced energy requirements for tower reboilers, or a combination thereof. Alternatively, the advantages of the present invention may be realized by accomplishing higher recovery levels for a given amount of utility consumption, or through some combination of higher recovery and improvement in utility consumption.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of liquefied natural gas containing methane and heavier hydrocarbon components and a gas stream containing methane and heavier hydrocarbon components into a volatile residue gas fraction containing a major portion of said methane and a relatively less volatile liquid fraction containing a major portion of said heavier hydrocarbon components wherein (a) said liquefied natural gas is divided into at least a first liquid stream and a second liquid stream;

(b) said first liquid stream is expanded to lower pressure and is thereafter supplied to a distillation column at an upper mid-column feed position;

(c) said second liquid stream is heated sufficiently to vaporize it, thereby forming a vapor stream;

(d) said vapor stream is expanded to said lower pressure and is supplied to said distillation column at a lower mid-column feed position;

(e) said gas stream is divided into at least a first gaseous stream and a second gaseous stream;

(f) said first gaseous stream is cooled to condense substantially all of it and is thereafter expanded to said lower pressure whereby it is further cooled;

(g) said expanded substantially condensed first gaseous stream is thereafter supplied to said distillation column at an additional upper mid-column feed position;

(h) said second gaseous stream is expanded to said lower pressure, is cooled, and is thereafter supplied to said distillation column at an additional lower mid-column feed position;

(i) an overhead distillation stream is withdrawn from an upper region of said distillation column and divided into at least a first portion and a second portion, whereupon said first portion is compressed to higher pressure;

(j) said compressed first portion is cooled sufficiently to at least partially condense it and form thereby a condensed stream, with said cooling supplying at least a portion of said heating of said second liquid stream;

(k) said condensed stream is divided into at least a volatile liquid stream and a reflux stream;

(l) said reflux stream is further cooled, with said cooling supplying at least a portion of said heating of said second liquid stream;

(m) said further cooled reflux stream is supplied to said distillation column at a top column feed position;

(n) said volatile liquid stream is heated sufficiently to vaporize it, with said heating supplying at least a portion of said cooling of one or more of said first gaseous stream and said expanded second gaseous stream;

(o) said second portion is heated, with said heating supplying at least a portion of said cooling of one or more of said first gaseous stream and said expanded second gaseous stream;

(p) said vaporized volatile liquid stream and said heated second portion are combined to form said volatile residue gas fraction containing a major portion of said methane; and (q) the quantity and temperature of said reflux stream and the temperatures of said feeds to said distillation column are effective to maintain the overhead temperature of said distillation column at a temperature whereby the major portion of said heavier hydrocarbon components is recovered in said relatively less volatile liquid fraction by fractionation in said distillation column.

2. The process according to claim 1 wherein (a) said expanded second gaseous stream is cooled sufficiently to partially condense it;

(b) said partially condensed expanded second gaseous stream is separated thereby to provide an additional vapor stream and a third liquid stream;

(c) said additional vapor stream is further cooled and thereafter supplied to said distillation column at said additional lower mid-column feed position;

(d) said third liquid stream is supplied to said distillation column at another lower mid-column feed position;

(e) said volatile liquid stream is heated sufficiently to vaporize it, with said heating supplying at least a portion of said cooling of one or more of said first gaseous stream, said expanded second gaseous stream, and said additional vapor stream; and (f) said second portion is heated, with said heating supplying at least a portion of said cooling of one or more of said first gaseous stream, said expanded second gaseous stream, and said additional vapor stream.

3. The process accordingly to claim 1 wherein (a) said second liquid stream is heated sufficiently to partially vaporize it;

(b) said partially vaporized second liquid stream is separated thereby to provide said vapor stream and a third liquid stream; and (c) said third liquid stream is expanded to said lower pressure and thereafter supplied to said distillation column at another lower mid-column feed position.

4. The process according to claim 3 wherein (a) said expanded second gaseous stream is cooled sufficiently to partially condense it;

(b) said partially condensed expanded second gaseous stream is separated thereby to provide an additional vapor stream and a fourth liquid stream;

(c) said additional vapor stream is further cooled and thereafter supplied to said distillation column at said additional lower mid-column feed position;

(d) said fourth liquid stream is supplied to said distillation column at a further lower mid-column feed position;

(e) said volatile liquid stream is heated sufficiently to vaporize it, with said heating supplying at least a portion of said cooling of one or more of said first gaseous stream, said expanded second gaseous stream, and said additional vapor stream; and (f) said second portion is heated, with said heating supplying at least a portion of said cooling of one or more of said first gaseous stream, said expanded second gaseous stream, and said additional vapor stream.

5. The process according to claim 1, 2, 3 or 4 wherein (a) said liquefied natural gas is heated and thereafter divided into at least said first liquid stream and said second liquid stream; and (b) said cooling of said compressed first portion and said reflux stream supply at least a portion of said heating of said liquefied natural gas.

* * * * *